US008336867B1

(12) United States Patent
Warth

(10) Patent No.: US 8,336,867 B1
(45) Date of Patent: Dec. 25, 2012

(54) WORKHOLDING APPARATUS HAVING A DETACHABLE JAW PLATE

(75) Inventor: Jeffrey M. Warth, Mars, PA (US)

(73) Assignee: Chick Workholding Solutions, Inc., Warrendale, PA (US)

( * ) Notice: Subject to any disclaimer, the term of this patent is extended or adjusted under 35 U.S.C. 154(b) by 1155 days.

(21) Appl. No.: 12/199,021

(22) Filed: Aug. 27, 2008

Related U.S. Application Data

(63) Continuation-in-part of application No. 11/897,210, filed on Aug. 29, 2007, now abandoned.

(60) Provisional application No. 60/841,824, filed on Sep. 1, 2006.

(51) Int. Cl.
*B25B 5/02* (2006.01)

(52) U.S. Cl. ..... 269/271; 269/43

(58) Field of Classification Search ..... 269/271, 269/43, 45, 156, 276, 170
See application file for complete search history.

(56) References Cited

U.S. PATENT DOCUMENTS

| | | | |
|---|---|---|---|
| 287,271 | A | 10/1883 | Gladwin |
| 307,439 | A | 11/1884 | Corbett |
| 463,332 | A | 11/1891 | Giles |
| 600,370 | A | 3/1898 | Kohler |
| 731,871 | A | 6/1903 | Echols |
| 1,262,621 | A | 4/1918 | Beacham |
| 1,329,602 | A | 2/1920 | Hultberg |
| 1,365,784 | A | 1/1921 | Arthur |
| 1,385,088 | A | 7/1921 | Mellor |
| 1,393,083 | A | 10/1921 | Campbell |
| 1,495,772 | A | 5/1924 | Brown |
| 1,550,751 | A | 8/1925 | Sinkler |
| 1,811,299 | A | 6/1931 | Brockhaus, Jr. |
| 1,850,178 | A | 3/1932 | McChesney |
| 2,061,718 | A | 11/1936 | Stahl |
| 2,227,443 | A | 1/1941 | Denner |
| 2,251,016 | A | 7/1941 | Gallimore |
| 2,274,428 | A | 2/1942 | Odin |
| 2,339,986 | A | 1/1944 | Engert |
| 2,369,425 | A | 2/1945 | Becker |
| 2,406,043 | A | 8/1946 | Sorensen |
| 2,487,742 | A | 11/1949 | Sutter |
| 2,499,124 | A | 2/1950 | Zipp et al. |
| 2,535,450 | A | 12/1950 | O'Malley et al. |
| 2,560,413 | A | 7/1951 | Carlson |
| 2,564,138 | A | 8/1951 | Walker |

(Continued)

FOREIGN PATENT DOCUMENTS

| | | |
|---|---|---|
| CH | 480 912 | 12/1969 |

(Continued)

*Primary Examiner* — Lee D Wilson
(74) *Attorney, Agent, or Firm* — K&L Gates LLP

(57) ABSTRACT

A device for holding a workpiece, the device comprising, in one form, a base and a jaw member, wherein the jaw member includes a detachable jaw plate. The jaw member can further include a lock assembly which can attach or affix the jaw plate to the jaw member. In at least one embodiment, the lock assembly can include a cam, or lock, configured to pull the jaw plate toward the jaw member and/or secure the jaw plate against the jaw member. In certain embodiments, the lock assembly can include a slide which can be moved by an actuator such that the slide can engage the jaw plate and move the jaw plate into position. In at least one such embodiment, the slide can pull the jaw plate against the jaw member and, in addition, pull the jaw plate downwardly against a workpiece support surface.

39 Claims, 32 Drawing Sheets

U.S. PATENT DOCUMENTS 2,570,857 A 10/1951 Purpura
2,630,702 A 3/1953 Pizzani
2,661,783 A 12/1953 Caston
2,699,708 A 1/1955 Fotsch
2,707,419 A 5/1955 Schron
2,711,904 A 5/1955 Gartner et al.
2,764,047 A 9/1956 Allbritton
2,770,990 A 11/1956 Rix
2,845,038 A 7/1958 Crawford
2,868,339 A 1/1959 Lazarowicz
2,880,638 A 4/1959 Mugglile et al.
2,885,910 A 5/1959 Waller
2,889,396 A 6/1959 Bode
2,952,169 A 9/1960 Johnson
2,976,844 A 3/1961 Goldring
3,020,998 A 2/1962 Webb
3,162,064 A 12/1964 Musy
3,186,260 A 6/1965 Dugas
3,203,082 A 8/1965 Robbins
3,204,490 A 9/1965 Jones et al.
3,397,880 A 8/1968 Kuban
3,403,901 A 10/1968 Serivadio
3,496,832 A 2/1970 Celinder et al.
3,514,092 A 5/1970 Lassy
3,565,417 A 2/1971 Degle
3,612,384 A 10/1971 Loyd et al.
3,814,448 A 6/1974 Buck
3,835,649 A 9/1974 Le Testu
3,861,664 A 1/1975 Durkee
3,967,816 A 7/1976 Ramsperger et al.
3,968,415 A 7/1976 Hafla et al.
4,017,267 A 4/1977 Hawley
4,019,726 A 4/1977 Turner
4,043,547 A 8/1977 Glomb et al.
4,068,834 A 1/1978 Mortoly
4,089,613 A 5/1978 Babbitt, Jr.
4,098,500 A 7/1978 Lenz
4,121,817 A 10/1978 Pavlovsky
4,125,251 A 11/1978 Jamieson, Jr.
4,165,869 A 8/1979 Williams
4,170,345 A 10/1979 Townsend
4,184,691 A 1/1980 Esser et al.
4,205,833 A 6/1980 Lenz
4,221,369 A 9/1980 Takasugi
4,240,621 A 12/1980 Daddato
4,252,304 A 2/1981 Pettican
4,295,641 A 10/1981 Boucher
4,319,516 A 3/1982 Rohm
4,324,161 A 4/1982 Klancnik et al.
4,353,271 A 10/1982 Pieczulewski
4,413,818 A 11/1983 Lenz
4,496,165 A 1/1985 Schrekeis et al.
4,504,046 A 3/1985 Yonezawa et al.
4,524,655 A 6/1985 Waldron et al.
4,529,183 A 7/1985 Krason
4,545,470 A 10/1985 Grimm
4,569,509 A 2/1986 Good
4,571,131 A 2/1986 Date
4,585,217 A 4/1986 Erickson
4,619,446 A 10/1986 Yang
4,643,411 A 2/1987 Izumi
4,644,825 A 2/1987 Yamazaki
4,664,394 A 5/1987 Theissig et al.
4,669,161 A 6/1987 Sekelsky, Jr.
4,684,115 A 8/1987 Krause
4,685,663 A 8/1987 Jorgensen
4,711,437 A 12/1987 Longenecker et al.
4,738,438 A 4/1988 Horie et al.
4,773,636 A 9/1988 Takahashi
4,779,857 A 10/1988 Maund
4,799,657 A 1/1989 Miller
4,807,863 A 2/1989 Yang
4,813,310 A 3/1989 Moynihan
4,834,358 A 5/1989 Okolischan et al.
4,850,099 A 7/1989 Scollard
4,881,727 A 11/1989 Nemirovsky
4,884,474 A 12/1989 Kawata
4,898,371 A 2/1990 Mills et al.
4,921,378 A 5/1990 Kytola
4,928,937 A 5/1990 Bernstein
4,934,674 A 6/1990 Bernstein
4,936,559 A 6/1990 Diaz Torga
4,946,178 A 8/1990 Korson et al.
4,966,350 A 10/1990 Chick
4,968,012 A 11/1990 Haddad et al.
4,971,301 A 11/1990 Yang
4,974,308 A 12/1990 Nimberger
4,986,704 A 1/1991 Narushima et al.
4,991,463 A 2/1991 Kawata
5,005,890 A 4/1991 Schwenger
5,013,017 A 5/1991 Swann
5,015,003 A 5/1991 Ramunas
5,022,636 A 6/1991 Swann
5,024,427 A 6/1991 Swann
5,033,724 A 7/1991 James
5,064,321 A 11/1991 Barnes
5,090,529 A 2/1992 Fahy et al.
5,094,436 A 3/1992 Stephan, III
5,098,073 A * 3/1992 Lenz ..... 269/43
5,114,126 A 5/1992 Yasue
5,129,637 A 7/1992 Ito et al.
5,136,896 A 8/1992 Burka
5,159,580 A 10/1992 Andersen et al.
5,160,124 A 11/1992 Yamada et al.
5,160,335 A 11/1992 Wagenknecht
5,161,788 A 11/1992 Guzzoni
5,163,662 A * 11/1992 Bernstein ..... 269/136
5,193,792 A 3/1993 DiMarco
5,242,159 A 9/1993 Bernstein
5,251,887 A 10/1993 Arnold
5,306,136 A 4/1994 Oomori et al.
5,314,283 A 5/1994 Zoltner
5,322,305 A 6/1994 Cross et al.
5,339,504 A 8/1994 Thumm et al.
5,351,943 A 10/1994 Milz
5,374,040 A 12/1994 Lin
5,374,145 A 12/1994 Mairesse et al.
5,441,284 A 8/1995 Mueller et al.
5,442,844 A 8/1995 Swann
5,458,321 A 10/1995 Durfee, Jr.
5,501,123 A 3/1996 Swann et al.
5,526,715 A 6/1996 Swann et al.
5,531,428 A 7/1996 Dembicks et al.
5,535,995 A 7/1996 Swann et al.
5,549,427 A 8/1996 Hiestand
5,562,277 A 10/1996 Swann et al.
5,623,754 A 4/1997 Swann et al.
5,623,757 A 4/1997 Durfee, Jr.
5,629,816 A 5/1997 Busengdal et al.
5,634,253 A 6/1997 Swann et al.
5,649,694 A 7/1997 Buck
5,713,118 A 2/1998 Swann et al.
5,720,476 A 2/1998 Swann et al.
5,735,514 A 4/1998 Moore et al.
5,746,423 A 5/1998 Arov
5,762,326 A 6/1998 Swann
5,806,841 A 9/1998 Hebener
5,873,499 A 2/1999 Leschinsky et al.
5,921,534 A 7/1999 Swann et al.
5,971,380 A 10/1999 Hebener
6,000,304 A 12/1999 Hegemier
6,012,712 A * 1/2000 Bernstein ..... 269/43
6,032,940 A 3/2000 Wolfe
6,152,435 A 11/2000 Snell
6,164,635 A 12/2000 Chase et al.
6,170,814 B1 1/2001 Swann et al.
6,206,354 B1 3/2001 Lin
6,240,807 B1 6/2001 Hebener
6,244,580 B1 6/2001 Durfee, Jr.
6,250,620 B1 6/2001 Durfee
6,361,034 B1 * 3/2002 Wolfe ..... 269/8
6,598,867 B2 7/2003 Martinez
6,669,254 B2 12/2003 Thom et al.
6,761,349 B2 7/2004 McCraw
6,773,003 B2 * 8/2004 Dermody, Jr. ..... 269/282
6,976,670 B1 12/2005 Woolley et al.
7,258,333 B2 8/2007 Hobday

| | | | | |
|---|---|---|---|---|
| 7,293,765 | B2 | 11/2007 | Hooper | |
| 7,618,028 | B2 | 11/2009 | Huisken et al. | |
| 8,066,270 | B2 | 11/2011 | Siegel | |
| 8,109,494 | B1 | 2/2012 | Warth | |
| 2003/0005798 | A1 | 1/2003 | Kuchar | |
| 2003/0177627 | A1 | 9/2003 | Richardson | |
| 2005/0280196 | A1 | 12/2005 | Ray Avalani | |
| 2006/0055098 | A1 | 3/2006 | Siegel | |
| 2006/0091596 | A1 | 5/2006 | Marusiak | |
| 2008/0197607 | A1 | 8/2008 | Merino | |
| 2008/0217831 | A1* | 9/2008 | Siegel | 269/266 |
| 2009/0088774 | A1 | 4/2009 | Swarup et al. | |
| 2010/0299890 | A1 | 12/2010 | Doyle | |
| 2011/0101587 | A1 | 5/2011 | Quintania et al. | |

FOREIGN PATENT DOCUMENTS

| | | | |
|---|---|---|---|
| DE | 1904673 | | 11/1964 |
| DE | 1918387 | | 4/1969 |
| DE | 1652956 | | 6/1969 |
| DE | 1750374 | | 1/1971 |
| DE | 2 407 554 | | 9/1974 |
| DE | 27 53 507 | | 6/1979 |
| DE | 39 29512 | A1 | 3/1991 |
| DE | 4339439 | | 3/1995 |
| EP | 233537 | A2 | 8/1987 |
| EP | 0 343 329 | A | 11/1989 |
| EP | 0 440 585 | | 8/1991 |
| EP | 0 450 538 | A2 | 9/1991 |
| EP | 0526432 | A1 | 7/1992 |
| FR | 2 307 602 | | 3/1976 |
| FR | 2 578 180 | | 9/1986 |
| GB | 562447 | | 3/1944 |
| GB | 1266942 | | 3/1972 |
| GB | 2073063 | A | 10/1981 |
| GB | 2075874 | A | 11/1981 |
| GB | 2 103 522 | | 7/1982 |
| GB | 2123722 | | 2/1984 |
| GB | 2177647 | A | 1/1987 |
| JP | 61-24446 | | 10/1986 |
| SU | 1397-250 | | 5/1988 |
| WO | WO 89/08518 | | 9/1989 |
| WO | WO 89/11950 | | 12/1989 |
| WO | WO 97/08594 | | 3/1997 |
| WO | WO 97/47429 | | 12/1997 |

* cited by examiner

WORKHOLDING APPARATUS HAVING A DETACHABLE JAW PLATE

CROSS-REFERENCE TO RELATED APPLICATIONS

This application is a continuation-in-part under 35 U.S.C. §120 of U.S. patent application Ser. No. 11/897,210, entitled WORKHOLDING APPARATUS HAVING A DETACHABLE JAW PLATE, filed on Aug. 29, 2007, now abandoned which claims the benefit under 35 U.S.C. §119(e) of U.S. Provisional Patent Application Ser. No. 60/841,824, entitled WORKHOLDING APPARATUS, filed on Sep. 1, 2006, the entire disclosures of which are hereby incorporated by reference herein.

BACKGROUND

1. Field of the Invention

The present invention generally relates to devices for holding workpieces and, more particularly, to devices used in connection with high precision machining (CNC, etc.) operations.

2. Description of the Related Art

High precision machining operations often utilize workholding devices, such as vises, for example, for holding a workpiece in position while the workpiece is cut, milled, and/or polished. As is well known in the art, financially successful machining operations utilize vises which are quickly and easily adaptable to hold a workpiece in different positions and orientations during the machining operation. These vises typically have included a rigid base, a fixed jaw member mounted to the base, and a movable jaw member. In use, the workpiece is often positioned between the fixed jaw member and the movable jaw member, wherein the movable jaw member is then positioned against the workpiece. In various embodiments, the jaw members have included a jaw face which is configured to contact the workpiece. In various circumstances, these jaw faces have oftentimes become worn or damaged and, as a result, previous jaw members have included replaceable jaw faces, or plates. In such embodiments, the jaw plates have been affixed to the jaw members with fasteners. Unfortunately, though, such fasteners have required a significant amount of time to assemble and have oftentimes become loose during use. What is needed is an improvement over the foregoing.

SUMMARY

The present invention includes a device for holding a workpiece, the device comprising, in one form, a base and a jaw member, wherein the jaw member includes a detachable jaw plate. In various embodiments, the jaw member can further include a lock assembly which can attach or affix the jaw plate to the jaw member. In at least one embodiment, the lock assembly can include a cam, or lock, configured to pull the jaw plate toward the jaw member and/or secure the jaw plate against the jaw member. In at least one such embodiment, the lock assembly can further include a cam actuator configured to move the cam between a first position in which the jaw plate is not secured to the jaw member and a second position in which the jaw plate is secured to the jaw member by the cam. In certain embodiments, the lock assembly can include a slide which can be moved by an actuator such that the slide can engage the jaw plate and move the jaw plate into position. In at least one such embodiment, the slide can pull the jaw plate against the jaw member and, in addition, pull the jaw plate downwardly against a workpiece support surface. In various embodiments, as a result of the above, a jaw plate can be quickly and easily attached to a jaw member without the use of fasteners. In at least one embodiment, for example, a cam actuator can be rotated less than one full revolution to move the cam between its first and second positions and secure the jaw plate to the jaw member.

BRIEF DESCRIPTION OF THE DRAWINGS

The above-mentioned and other features of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, in one form, and such exemplifications are not to be construed as limiting the scope of the invention in any manner.

DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present invention is defined solely by the claims. The features illustrated or described in connection with one exemplary embodiment may be combined with the features of other embodiments. Such modifications and variations are intended to be included within the scope of the present invention.

Figure 1:
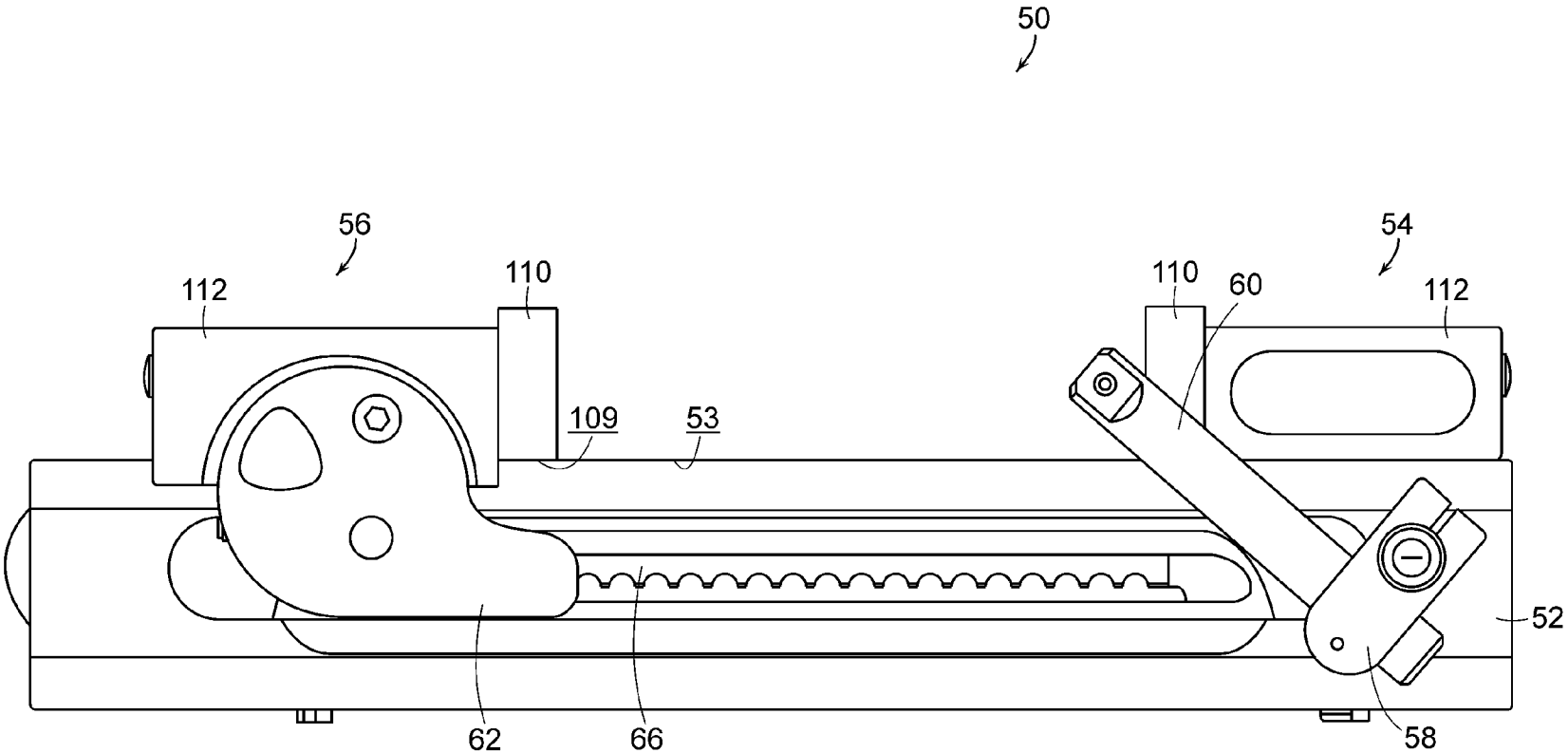
FIG. 1 is an elevational view of an exemplary workholding device in accordance with an embodiment of the present invention.

In various embodiments, referring to FIG. 1, workholding device 50 can include base 52, first jaw member 54, and second jaw member 56. In use, a workpiece can be positioned on surface 53 of base 52 intermediate first jaw member 54 and second jaw member 56 wherein at least one of jaw members 54 and 56 can be positioned or moved against the workpiece to apply a clamping force thereto. In the illustrated embodiment, first jaw member 54 can be fixedly mounted to base 52 and second jaw member 56 can be movable relative to base 52. In various alternative embodiments, although not illustrated, a workholding device can include two or more movable jaw members. In either event, in at least one embodiment, device 50 can further include work stop 58 which can be configured to control at least the transverse position of the workpiece within device 50. More particularly, in at least one embodiment, work stop 58 can include a post which is adjustably threaded into base 52 and, in addition, a friction clamp configured to allow extension rod 60 to be rotated into any suitable orientation or extended into any suitable position. In various embodiments, work stop 58 can further include a threaded rod or set screw extending from extension rod 60 which can be adjusted to abut the workpiece and hold the workpiece in position.

Figure 2:
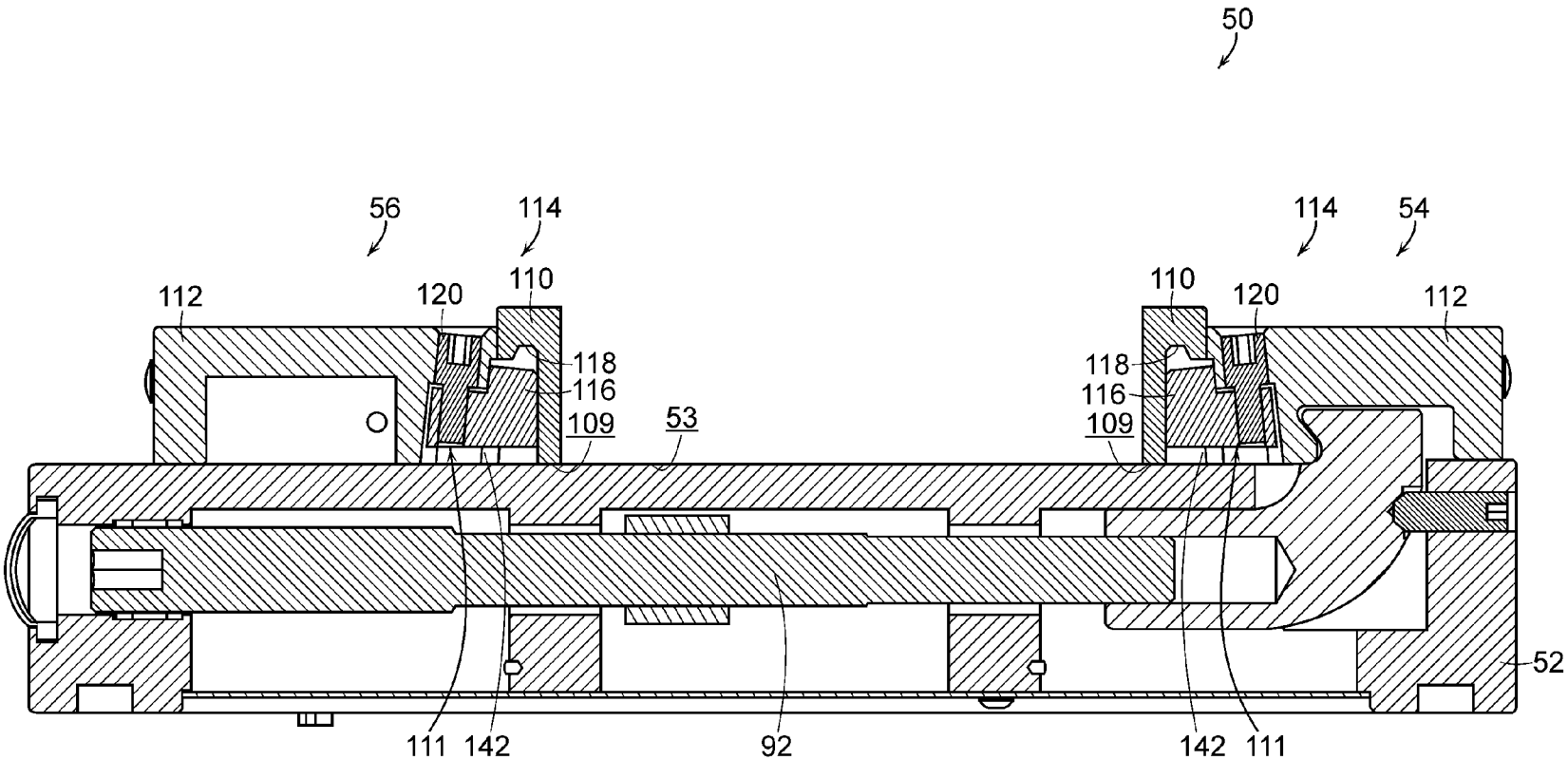
FIG. 2 is a cross-sectional view of the workholding device of FIG. 1.

In various embodiments, referring to FIG. 1, second jaw member 56 can include one or more connection members 62 which can be selectively actuated to hold jaw member 56 in position and/or allow second jaw member 56 to be moved relative to base 52. In certain embodiments, connection members 62 can be biased into a first position (FIG. 1) such that they are engaged with one or more racks 66 and, owing to the engagement between connection members 62 and racks 66, connection members 62 can hold second jaw member 56 in position relative to base 52. In at least one such embodiment, connection members 62 can be pivoted away from racks 66 (not illustrated) which can permit second jaw member 56 to be moved, or slid, relative to base 52. In various embodiments, referring to FIG. 2, workholding device 50 can further include a drive member 92 operably engaged with racks 66 and first jaw member 54 wherein drive member 92 can be actuated, or rotated, to move second jaw member 56 relative to first jaw member 54 in small increments.

Figure 3:
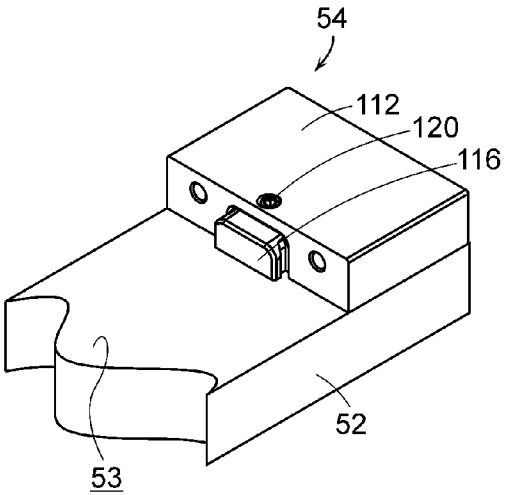
FIG. 3 is a partial perspective view of a jaw member and a jaw base of a workholding device similar to the workholding device of FIG. 1.
Figure 4:
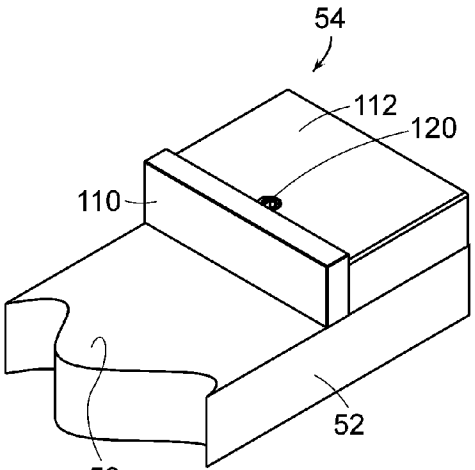
FIG. 4 is a partial perspective view of a jaw plate positioned relative to the jaw member of FIG. 3.
Figure 5:
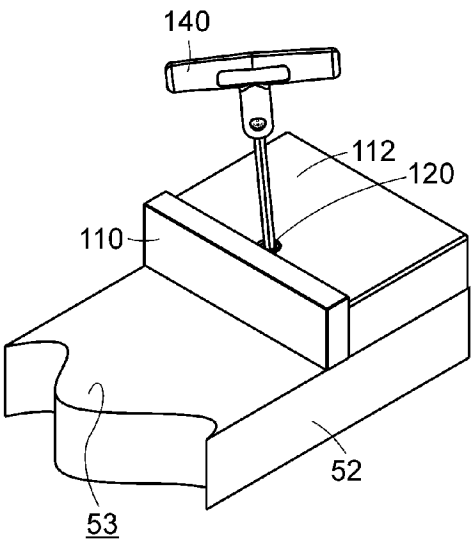
FIG. 5 is a partial perspective view of a wrench being used to actuate an actuator mounted in the jaw member of FIG. 3 for moving the jaw plate against the jaw base and/or jaw member.
Figure 6:
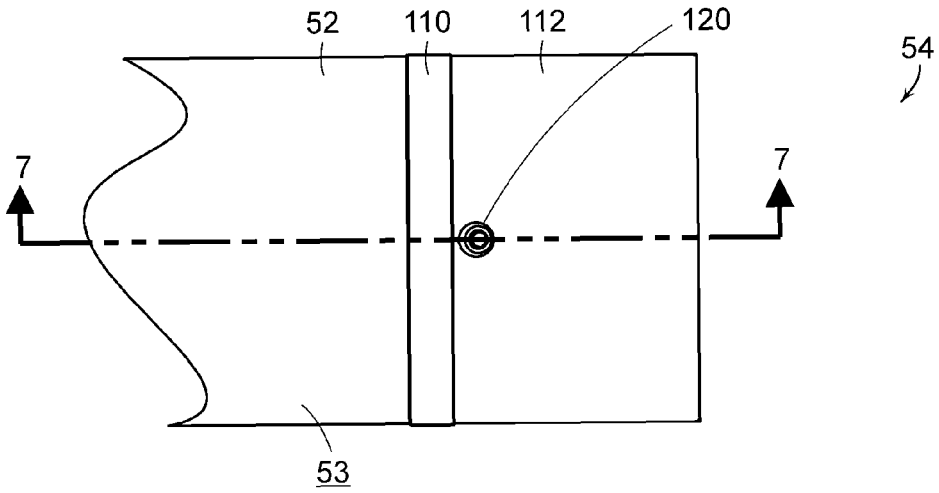
FIG. 6 is a partial plan view of the workholding device of FIG. 4.
Figure 7:
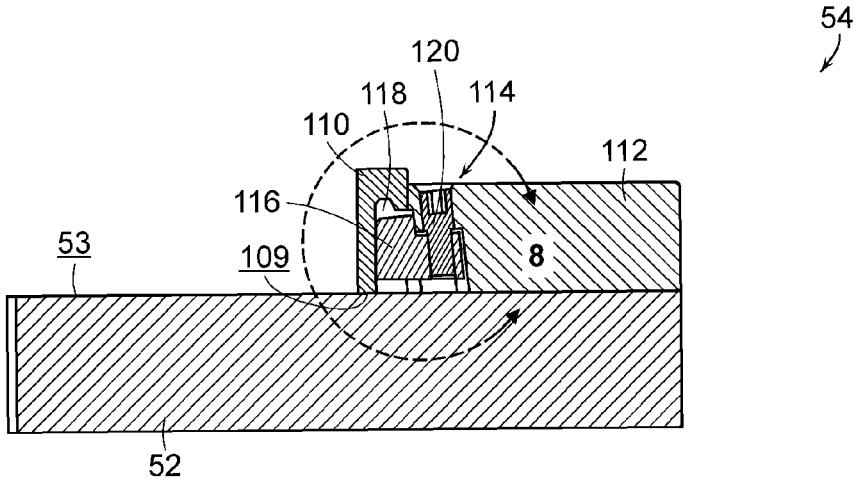
FIG. 7 is a partial cross-sectional view of the workholding device of FIG. 4 taken along line 7-7 in FIG. 6.

In various embodiments, each jaw member can include at least one jaw plate configured to contact a workpiece. During use, though, the jaw plates can become worn and, in various other circumstances, an operator may desire to replace the jaw plates with jaw plates having a different configuration more suitable for a particular application, for example. In either event, a workholding device in accordance with an embodiment of the present invention can include a removable, or detachable, jaw plate. In at least one such embodiment, referring to FIG. 2, first jaw member 54, for example, can include removable jaw plate 110, body portion 112, and lock assembly 114. In use, referring to FIGS. 2-4, jaw plate 110 can be positioned against, or in close opposition to, body portion 112 such that slide cam 116 of lock assembly 114 can be positioned within recess 118 in jaw plate 110. In such embodiments, as described in greater detail below, cam 116 can be actuated to retain jaw plate 110 to body portion 112. In certain embodiments, referring to FIG. 5, a tool 140, such as an Allen wrench, for example, can be engaged with a cam actuator in order to actuate cam 116.

In various embodiments, referring to FIGS. 6-9, lock assembly 114 can further include cam actuator 120 which can include a threaded end threadably received in an aperture 121 in cam 116. In at least one such embodiment, as described in greater detail below, cam actuator 120 can be rotated to move cam 116 downwardly, or at least substantially downwardly, and, correspondingly, pull jaw plate 110 against body portion 112. Referring to FIGS. 8A and 8B, cam 116 can be configured to slide along an angled surface, or track, on body portion 112 such that, when cam 116 is moved downwardly, cam 116 can also be moved inwardly. In at least one such embodiment, the angled surface can be oriented at an approximately 6 degree angle with respect to a vertical direction, for example. When cam 116 is moved inwardly, cam 116 can contact the walls of recess 118 and pull jaw plate 110 toward body portion 112. Correspondingly, when cam 116 is moved upwardly by actuator 120, cam 116 can be moved outwardly, or away from, body portion 112. When cam 116 is moved outwardly, cam 116 can release jaw plate 110 from body portion 112 and/or allow an operator to disengage jaw plate 110 from cam 116. In various embodiments, as a result of the above, a jaw plate can be quickly and easily attached to, and removed from, a jaw member without the use of fasteners.

Figure 8A:
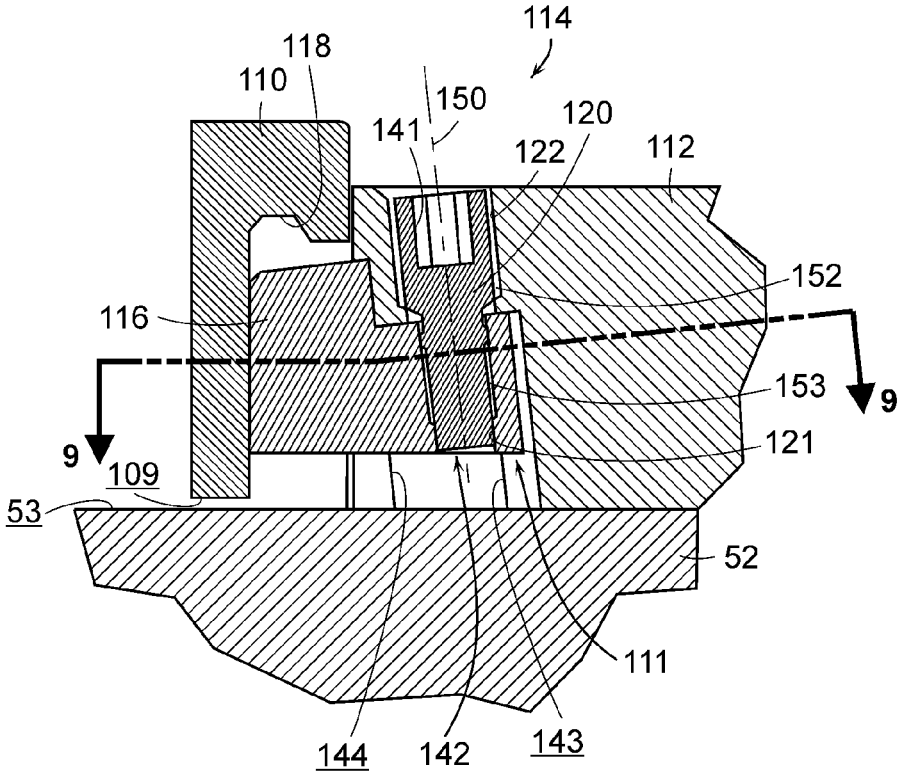
FIG. 8A is a detail view of the jaw base, jaw member, jaw plate, and actuator of FIGS. 3-5.
Figure 8B:
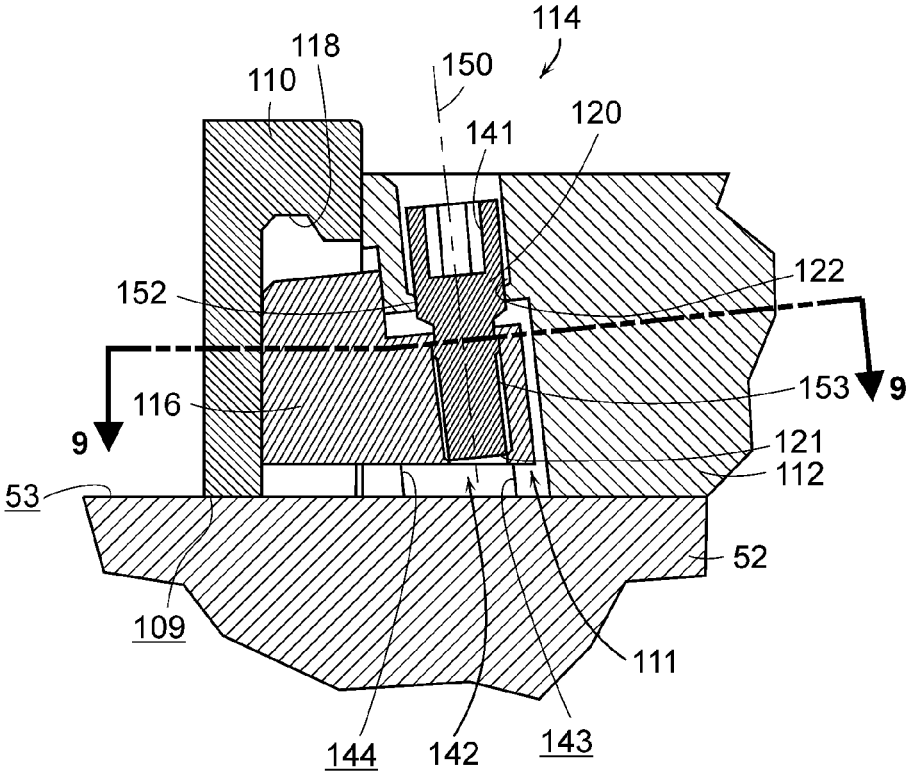
FIG. 8B is a detail view illustrating the jaw plate positioned against the jaw base and the jaw member of FIG. 5 after the actuator has been used to move a cam slide along a predetermined path.
Figure 9:
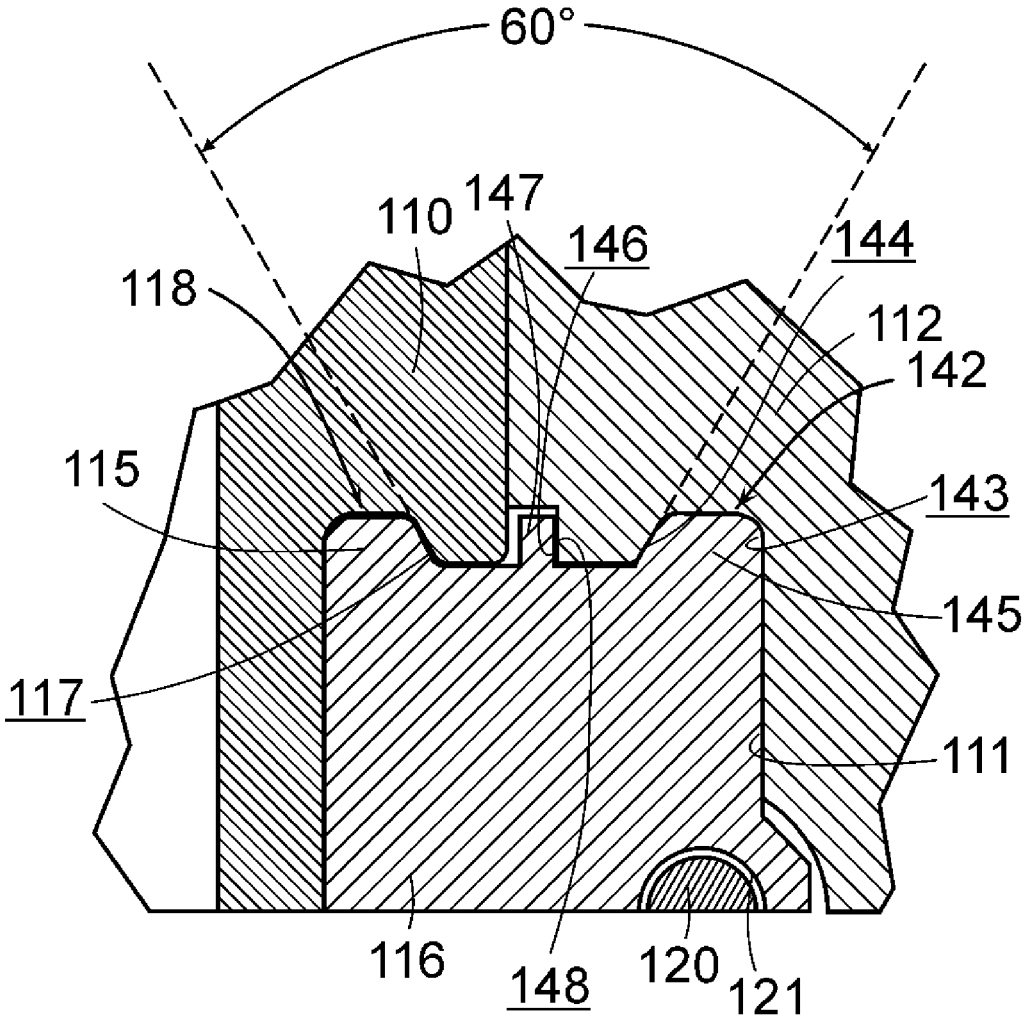
FIG. 9 is a partial cross-sectional view of the jaw member, jaw plate, actuator and slide of FIGS. 8A and 8B taken along line 9-9 in FIGS. 8A and 8B.

Further to the above, referring to FIGS. 8A, 8B, and 9, jaw body portion 112 can include track 142 which can be configured to define a predetermined path for slide 116. In certain embodiments, track 142 can comprise a groove or slot within body portion 112 which can be configured to slidably receive one or more flanges 145 extending from cam, or slide, 116. In at least one embodiment, track 142 can include a back surface 143 and a front surface 144 which can be configured to prevent, or at least inhibit, relative movement between slide 116 and body portion 112 except along the predetermined path. Further to the above, surfaces 143 and 144 can comprise substantially flat surfaces which are oriented at an approximately 6 degree angle with respect to a vertical direction. Stated another way, in certain embodiments, surfaces 143 and 144 can extend at an approximately 84 degree angle with respect to workpiece support surface 53, for example. Correspondingly, flange 145 can include angled surfaces which are parallel to, or at least substantially parallel to, surfaces 143 and 144, for example. In at least one such embodiment, flange 145 can be sized and configured such that it abuts, or is at least positioned adjacent to, surfaces 143 and 144. In such circumstances, flange 145 can be closely received within track 142 such that track 142 can define a path or axis along which slide 116 can be moved.

In various embodiments, further to the above, body portion 112 can further include one or more front surfaces 146 (FIG. 9) which can also be configured to guide slide 116 along a predetermined path. In at least one such embodiment, slide 116 can include one or more flanges 147 extending therefrom which can be guided by front surfaces 146 along an axis parallel to, or at least substantially parallel to, the axis defined by track 142. Similar to the above, surfaces 146 can be oriented at an approximately 6 degree angle with respect a vertical direction. Correspondingly, at least a portion of flange 147, or at least a backside surface 148 of flange 147, for example, can also be oriented at an approximately 6 degree angle such that surfaces 146 and 148 can be parallel, or at least substantially parallel, to each other in order to permit slide 116 to slide relative to body portion 112. In certain embodiments, backside surface 148 of flange 147 can abut front guide surfaces 146. In various embodiments, as outlined above, actuator 120 can be operably engaged with slide 116 such that, when actuator 120 is rotated, or is otherwise operated, slide 116 can be slid along axis 150. In at least one such embodiment, as illustrated in FIGS. 8A and 8B, axis 150 can also be oriented at an approximately 6 degree angle with respect to a vertical direction. In certain embodiments, the orientation of axis 150 can be dictated by the axis about which actuator 120 is rotated. For example, actuator 120 can be rotatably mounted within actuator aperture 122 in body portion 112 at an approximately 6 degree angle such that the axis of rotation about which actuator 120 is rotated is at an approximately 6 degree angle.

In various embodiments, further to the above, actuator 120 can include at least two threaded portions such as, for example, a first threaded portion 152 (FIGS. 8A and 8B) threadably engaged with actuator aperture 122 and a second threaded portion 153 threadably engaged with aperture 121 in slide 116. In at least one embodiment, actuator 120 can be rotated in a first direction, such as a clockwise direction, for example, such that actuator 120 is moved generally downwardly along axis 150 owing to the threaded engagement between first threaded portion 152 and actuator aperture 122. It is to be understood that the relationship between the rotation of actuator 120 and the direction in which actuator 120 is moved along axis 150 will depend on whether right-handed or left-handed threads are used. In any event, owing to the rotation of actuator 120, the threaded engagement between second threaded portion 153 of actuator 120 and threaded aperture 121 in slide 116 can cause a reactionary force between actuator 120 and slide 116 such that slide 116 is either pulled upwardly or pushed downwardly by actuator 120, again depending on whether right-handed or left-handed threads are used. In certain embodiments, track 142 and flanges 145, for example, can cooperate to prevent, or at least inhibit, slide 116 from rotating with actuator 120 such that the reactionary force between slide 116 and actuator 120 results in the linear, or at least substantially linear, movement of slide 116. In certain embodiments, as a result, the rotation of actuator 120 in a first direction can move slide 116 generally downwardly along axis 150 and, correspondingly, the rotation of actuator 120 in an opposite, or second, direction can move slide 116 generally upwardly along axis 150.

When slide 116 is moved generally downwardly along axis 150, owing to the tilt, or orientation, of axis 150, slide 116 can be moved both downwardly toward workpiece support surface 53 and inwardly toward jaw body portion 112. As outlined above, slide 116 can be operably engaged with jaw plate 110 such that, as slide 116 is moved downwardly and inwardly by actuator 120, slide 116 can move jaw plate 110 downwardly and inwardly as well. In various embodiments, referring to FIG. 9, jaw plate 110 can include one or more grooves or recesses 118 which can be sized and configured to slidably receive one or more flanges 115 extending from slide 116. In various embodiments, each recess 118 can include one or more lock surfaces, such as lock surface 117, for example, wherein flanges 115 can be configured to abut lock surfaces 117 and, as slide 116 is pulled inwardly as described above, move jaw plate 110 inwardly. In various embodiments, referring to FIG. 9, lock surfaces 117 of jaw plate 110, front surfaces 144 of track 142, and/or the co-operating angled surfaces of flanges 115 and 145 can be structured and arranged so as to locate slide 116 in the transverse, or side-to-side, direction such that it is aligned, or at least substantially aligned, in the transverse direction with respect to jaw body portion 112. In at least one such embodiment, surfaces 117 and 144 can define an approximately 60 degree angle therebetween. In certain embodiments, surfaces 117 and 144 can define an approximately 35 degree angle, an approximately 40 degree angle, an approximately 45 degree angle, an approximately 50 degree angle, an approximately 55 degree angle, an approximately 65 degree angle, an approximately 70 degree angle, an approximately 75 degree angle, an approximately 80 degree angle, and/or any other suitable angle therebetween. In at least one embodiment, surfaces 117 and 144 can define an angle which is between approximately 40 degrees and approximately 45 degrees. In certain embodiments, surfaces 117 and 144 can define an approximately 40 degree angle, an approximately 41 degree angle, an approximately 42 degree angle, an approximately 43 degree angle, an approximately 44 degree angle, and/or an approximately 45 degree angle therebetween.

In various embodiments, further to the above, the angle defined between surfaces 117 and 144 can be selected such that it can provide at least two advantages. For example, the angle can be selected such that it, first, reduces or eliminates side-to-side movement of jaw plate 110 and, second, allows clamping forces to be efficiently transmitted between slide 116, plate 110, and body portion 112. In at least one embodiment, the angle between surfaces 117 and 144 can be shallow, such as less than approximately 45 degrees, for example, and, in at least one embodiment, the angle can be steep, such as greater than approximately 45 degrees, for example. Embodiments having a shallow angle can provide a better clamping force between slide 116, jaw plate 110, and/or body portion 112, for example, as compared to embodiments having a steeper angle. Stated another way, shallower angles between surfaces 117 and 144 can permit a larger portion of the force, or forces, transmitted between slide 116, jaw plate 110, and body portion 112 to be transmitted in the clamping direction as opposed to a transverse direction. On the other hand, steeper angles between surfaces 117 and 144 can provide better side-to-side control of jaw plate 110 relative to body portion 112 as compared to embodiments having a shallower angle.

In various embodiments, as outlined above, actuator 120 can be rotated by a tool, such as an Allen wrench, for example. In at least one embodiment, referring to FIGS. 8A and 8B, actuator 120 can include a tool-receiving aperture 141 which can be configured to receive an end of tool 140, for example, such that rotational movement of tool 140 can be transmitted to actuator 120. Further to the above, as slide 116 is moved downwardly along axis 150 by actuator 120, slide 116 can move, or pull, jaw plate 110 downwardly toward workpiece support surface 53. In various embodiments, slide 116 can pull jaw plate 110 downwardly until bottom surface 109 of jaw plate 110 contacts support surface 53, for example. By positioning bottom surface 109 against support surface 53, jaw plate 110 can prevent, or at least inhibit, debris, such as chips or dust, for example, from entering into recess 111 in jaw body portion 110. In at least one embodiment, actuator 120 can be utilized to drive slide 116 downwardly in order to generate a friction force between slide 116 and jaw plate 110 so as to lock, or friction-lock, jaw plate 110 into place against surface 53, for example. In various embodiments, flange 115 of slide 116 can include surfaces which are parallel, or at least substantially parallel, to lock surfaces 117, for example. In at least one such embodiment, lock surfaces 117 and flange 115 can include vertical, or at least substantially vertical surfaces, for example. In other embodiments, similar to the above, lock surfaces 117 and the surfaces of flange 115 can be tilted, or oriented, in a direction which is approximately 6 degrees with respect to a vertical direction, for example.

In order to remove or replace jaw plate 110, for example, actuator 120 can be rotated in an opposite direction to move slide 116 generally upwardly along axis 150. In at least one such embodiment, actuator 120 can be rotated in a counter-clockwise direction in order to move slide 116 upwardly and away from workpiece support surface 53 and, in addition, outwardly and away from jaw body portion 112. Owing to the operative engagement between flanges 115 and recesses 118 as described above, flanges 115 can push jaw plate 110 outwardly from jaw body portion 112. In certain embodiments, slide 116 can also lift jaw plate 110 upwardly. In either event, slide 116 can be moved outwardly in order to release jaw plate 110, and/or break the friction-lock therebetween, such that jaw plate 110 can be removed. Although various embodiments are described herein in connection with an actuator that is tilted, or oriented, at an approximately 6 degree angle with respect to a vertical direction, other embodiments are envisioned in which an actuator is tilted, or oriented, at a different angle, such as approximately 2 degrees, approximately 3 degrees, approximately 4 degrees, approximately 5 degrees, approximately 7 degrees, approximately 8 degrees, approximately 9 degrees, approximately 10 degrees, and/or any other suitable angle. In such embodiments, the surfaces and sidewalls described above as having an approximately 6 degree orientation can be oriented such that they are parallel to, or at least substantially parallel to, the axis of the actuator.

Figure 10:
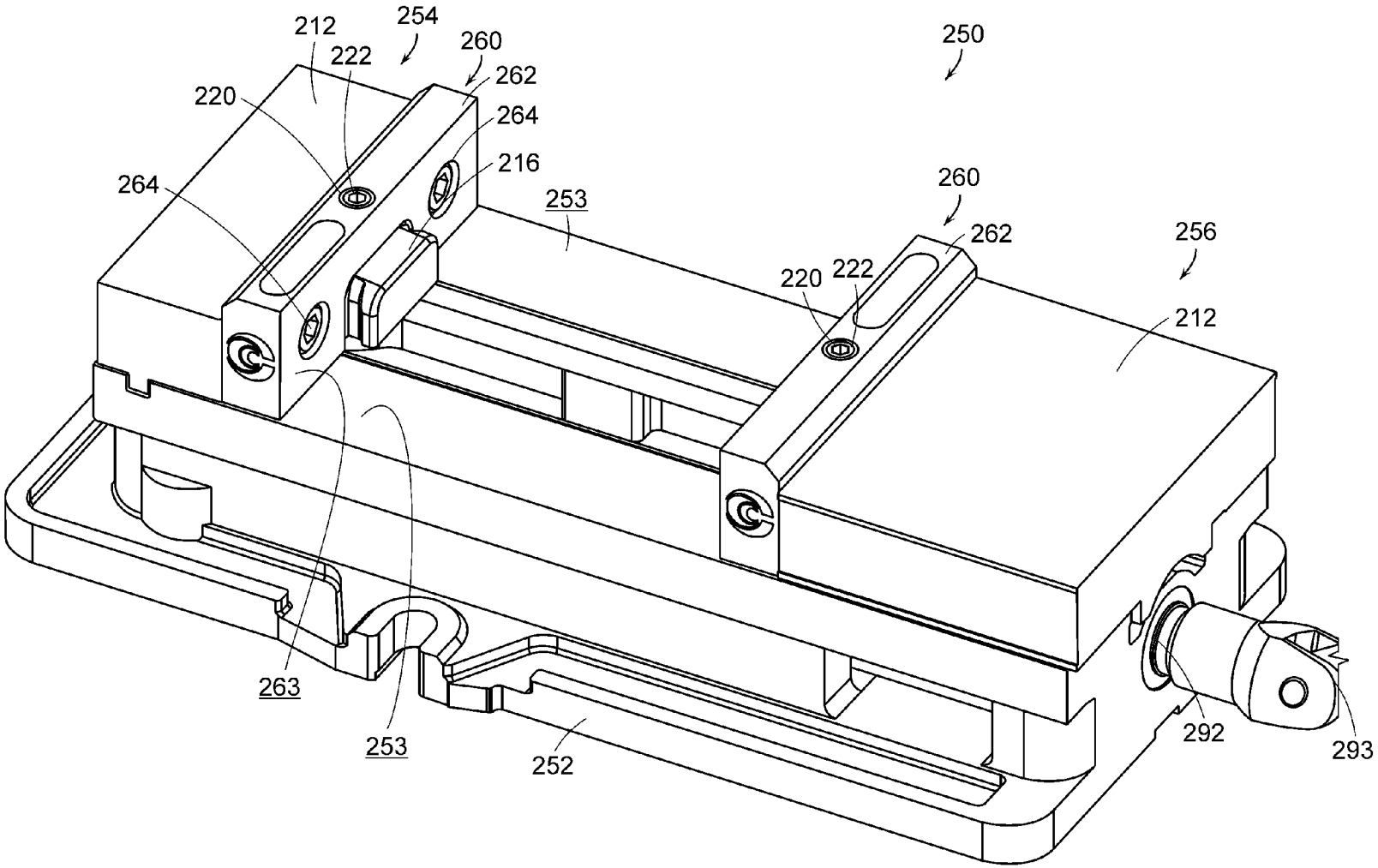
FIG. 10 is a perspective view of a workholding device in accordance with at least one alternative embodiment of the present invention including jaw plate adaptors for mounting jaw plates to the jaw members.
Figure 11:
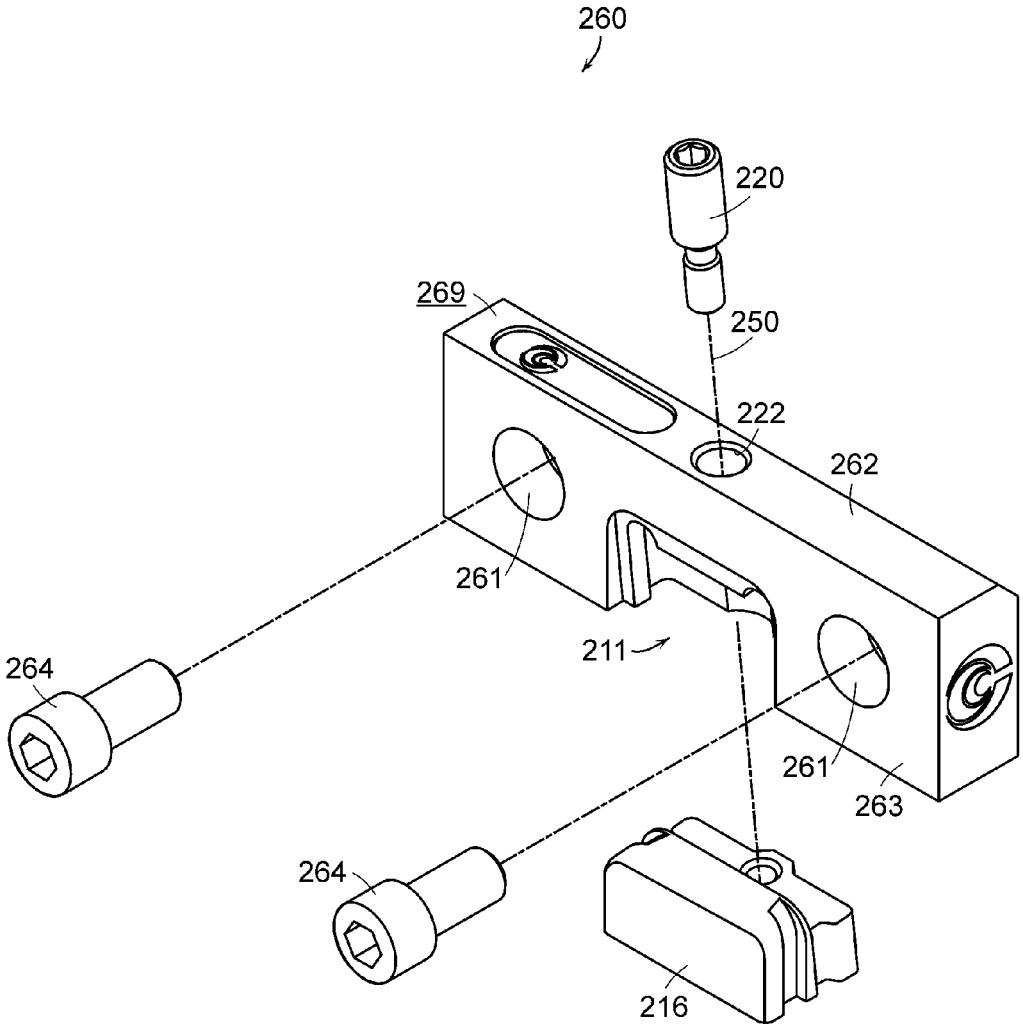
FIG. 11 is an exploded assembly view illustrating a jaw plate adaptor of FIG. 10 including a cam slide, an actuator for moving the slide, and fasteners for mounting the jaw plate adaptor to a jaw base.
Figure 13:
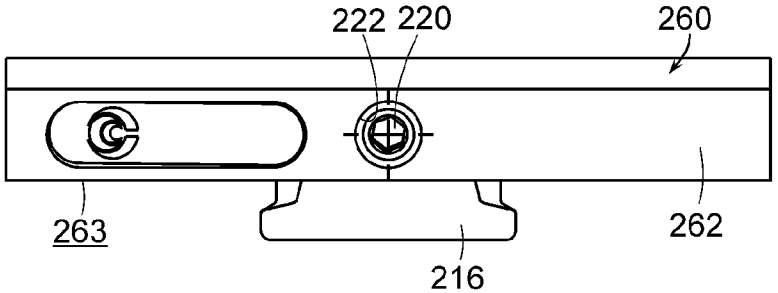
FIG. 13 is a top view of the jaw plate adaptor assembly of FIG. 11.
Figure 12:
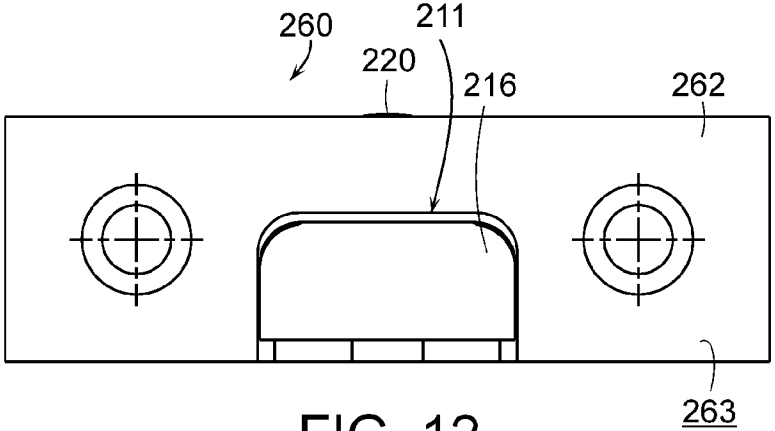
FIG. 12 is a front elevational view of the jaw plate adaptor assembly of FIG. 11.
Figure 14:
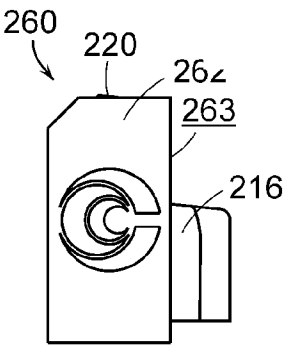
FIG. 14 is a side elevational view of the jaw plate adaptor assembly of FIG. 11.

In various embodiments, as described above and referring to FIGS. 8A and 8B, jaw body portion 112 can include an aperture 122 for receiving at least a portion of an actuator 120 and, in addition, a recess 111 for receiving at least a portion of slide 116. In various other embodiments, referring to FIG. 10, a workholding device, such as workholding device 250, for example, can include one or more jaw plate adaptors, or adaptor assemblies, which can be utilized to removably mount a jaw plate to a jaw member. In at least one such embodiment, jaw member 254, for example, can include a jaw body portion 212 and a jaw plate adaptor assembly 260 mounted thereto. In certain embodiments, referring generally to FIGS. 11-14, jaw plate adaptor assembly 260 can include one or more adaptor blocks 262, one or more fasteners 264 for mounting the adaptor block, or blocks, 262 to jaw body portion 212, and a slide cam 216 slidably mounted thereto. In various embodiments, adaptor block 262 can include one or more fastener apertures 261 which can be sized and configured to permit fasteners 264 to extend therethrough and threadably engage jaw body portion 212. Similar to the above, referring to FIG. 11, adaptor block 262 can include a recess 211 which can be configured to slidably receive at least a portion of slide 216 and, in addition, an actuator aperture 222 configured to receive at least a portion of actuator 220. Also similar to the above, actuator 220 and slide 216 can be threadably engaged such that, when actuator 220 is rotated, slide 216 can be moved generally upwardly and/or generally downwardly along axis 250. In various embodiments, again similar to the above, axis 250 can be oriented such that slide 216 can pull a jaw plate toward jaw body portion 212 and, in addition, toward workpiece support surface 253. In at least one such embodiment, slide 216 can pull the jaw plate until it contacts front surface 263 on adaptor block 262 and/or workpiece support surface 253. Also similar above, referring again to FIG. 10, workholding device 250 can further include drive member 292 which can be configured to be rotated by crank 293. In at least one such embodiment, drive member 292 can be threadably engaged with jaw member 256 such that the rotation of drive member 292 can move jaw member 256 toward jaw member 254 and clamp a workpiece therebetween.

Figure 15:
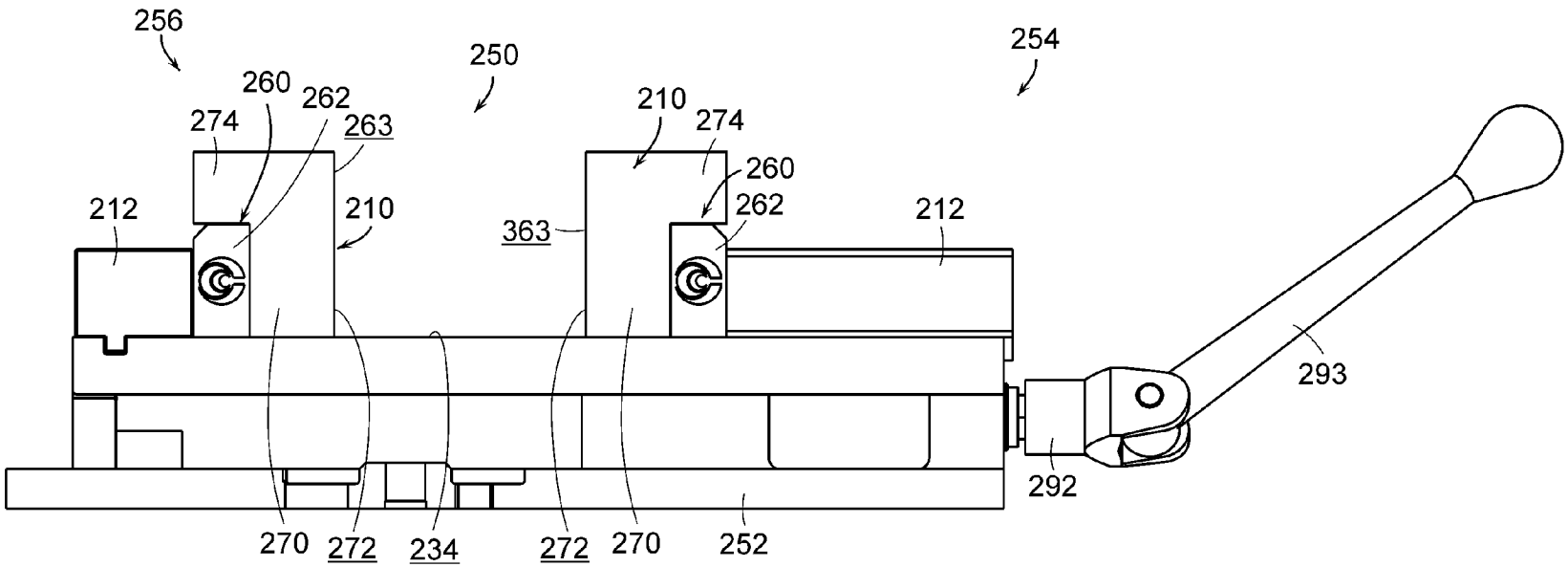
FIG. 15 is an elevational view of the workholding device of FIG. 10 having a set of jaw plates assembled thereto in accordance with at least one embodiment of the present invention.
Figure 16:
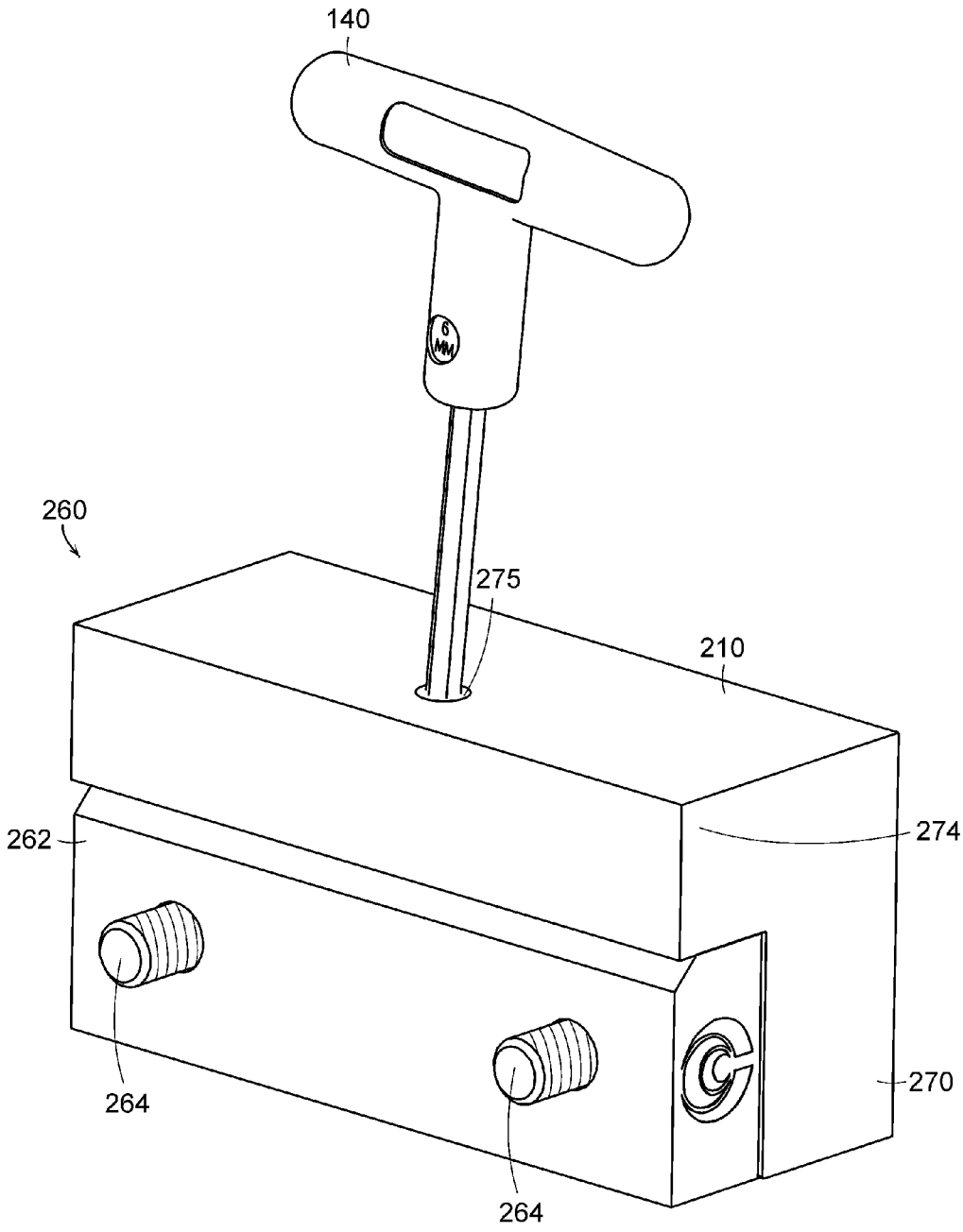
FIG. 16 is a perspective view of a jaw plate adaptor assembly of the workholding device of FIG. 10, a jaw plate of FIG. 15 assembled to the jaw plate adaptor assembly, and a tool operably engaged with an actuator in the jaw plate adaptor.
Figure 17:
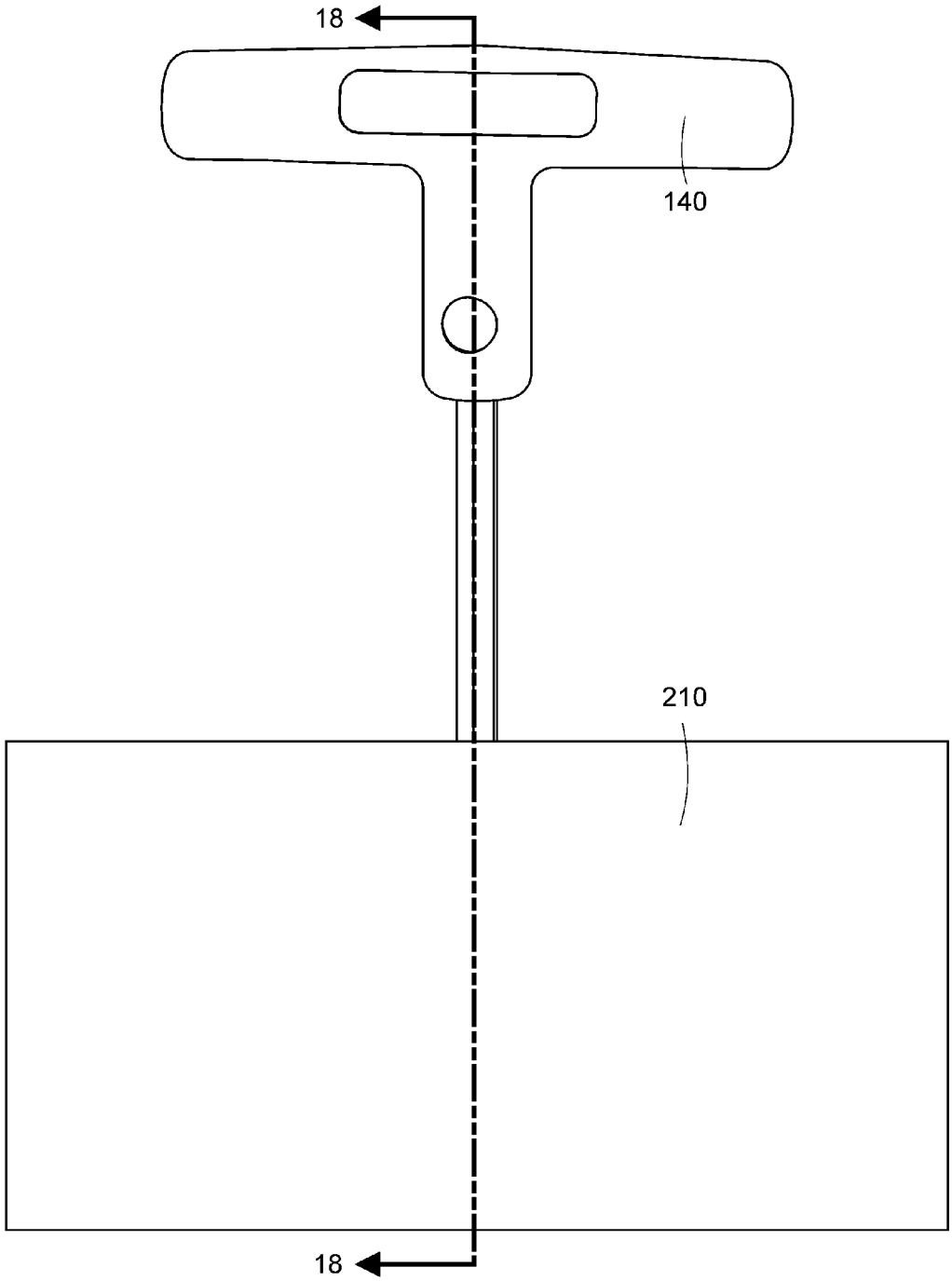
FIG. 17 is a front elevational view of the jaw plate and jaw plate adaptor assembly of FIG. 16.
Figure 18:
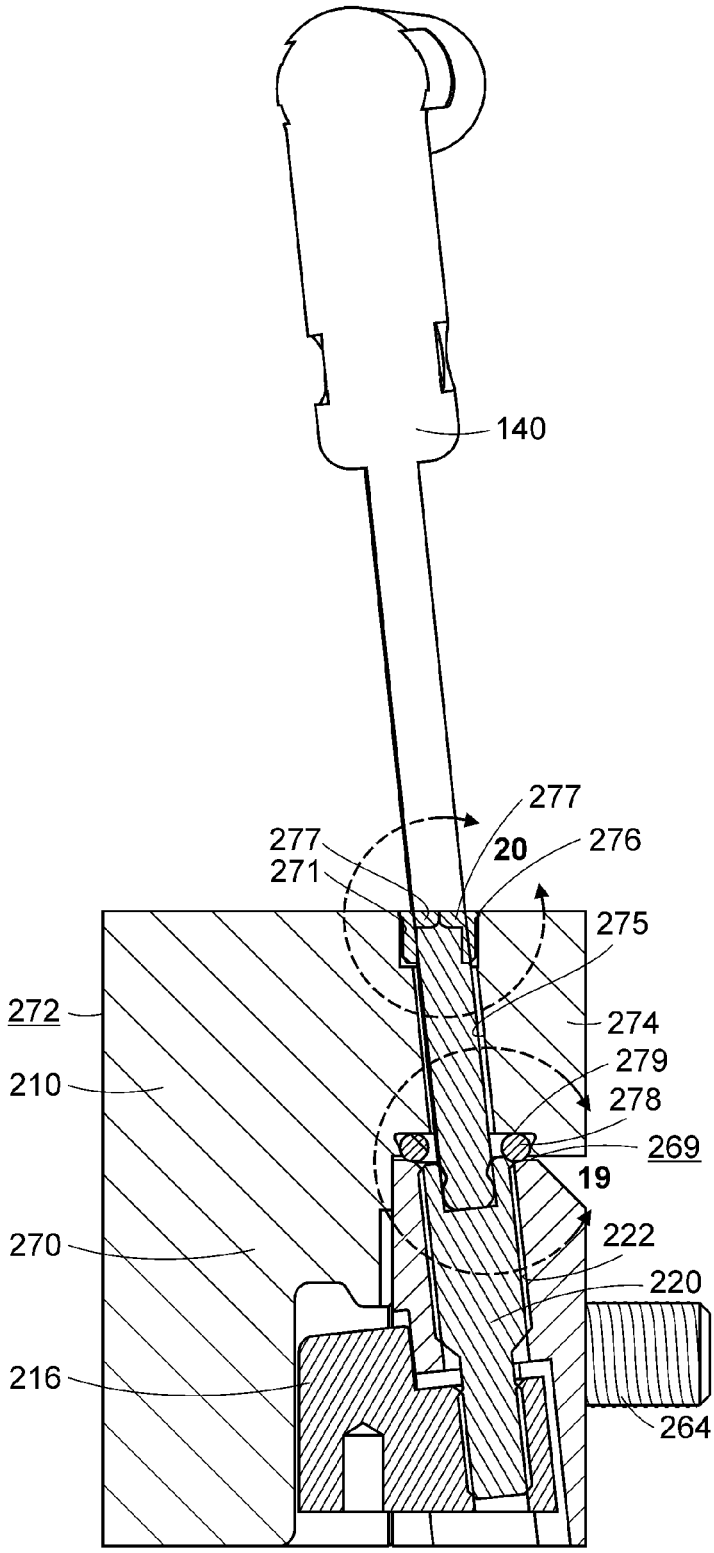
FIG. 18 is a cross-sectional view of the jaw plate and jaw plate adaptor assembly of FIG. 16 taken along line 18-18 in FIG. 17.
Figure 19:
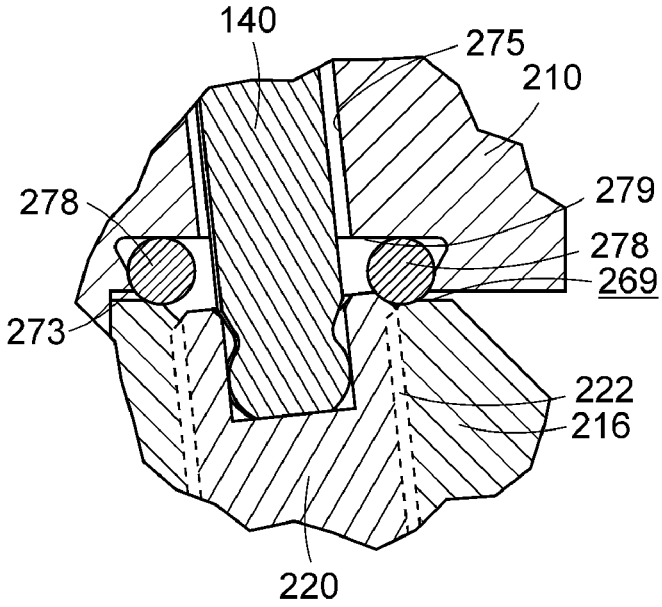
FIG. 19 is a detail view of the tool of FIG. 16 operably engaged with the actuator of the jaw plate adaptor assembly.

In various embodiments, adaptor assembly 260 can be configured to retain a variety of different jaw plates to a jaw member. In at least one embodiment, referring to FIGS. 15 and 16, an adaptor assembly 260 can be configured to attach a jaw plate 210 to jaw body portion 212 of first jaw member 254. Similarly, an adaptor assembly 260 can be utilized to attach a jaw plate 210 to jaw body portion 212 of second jaw member 256. In either event, jaw plate 210 can include a first portion 270 having a workpiece contacting surface 272 and, in addition, a second portion 274 which can be configured to overhang at least a portion of adaptor plate 262. In various embodiments, referring to FIGS. 16 and 17, the second, or overhang, portion 274 of jaw plate 210 can include a clearance hole 275 which can be configured to permit a tool, such as tool 140, for example, to be inserted therethrough and into operative engagement with actuator 220. In at least one such embodiment, referring to FIG. 18, jaw plate 210 can further include a top seal 276 and a bottom seal 278 which can be configured to permit tool 140 to be inserted therethrough but prevent, or at least inhibit, debris or dust, for example, from entering into aperture 222, for example.

Figure 20:
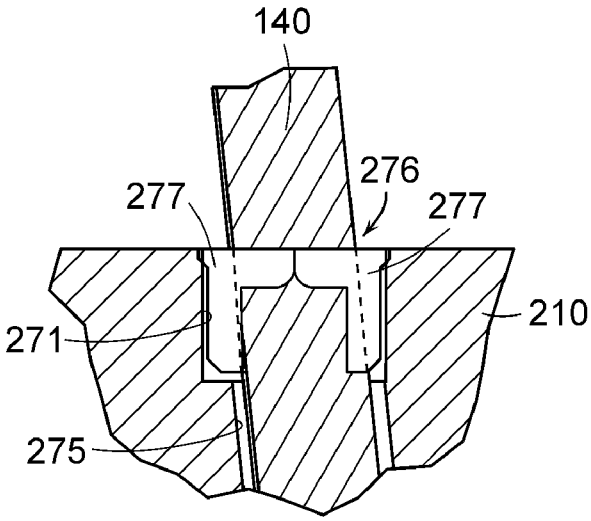
FIG. 20 is a detail view of the tool of FIG. 16 inserted through a sealed port, or aperture, in the jaw plate of FIG. 15.
Figure 21:
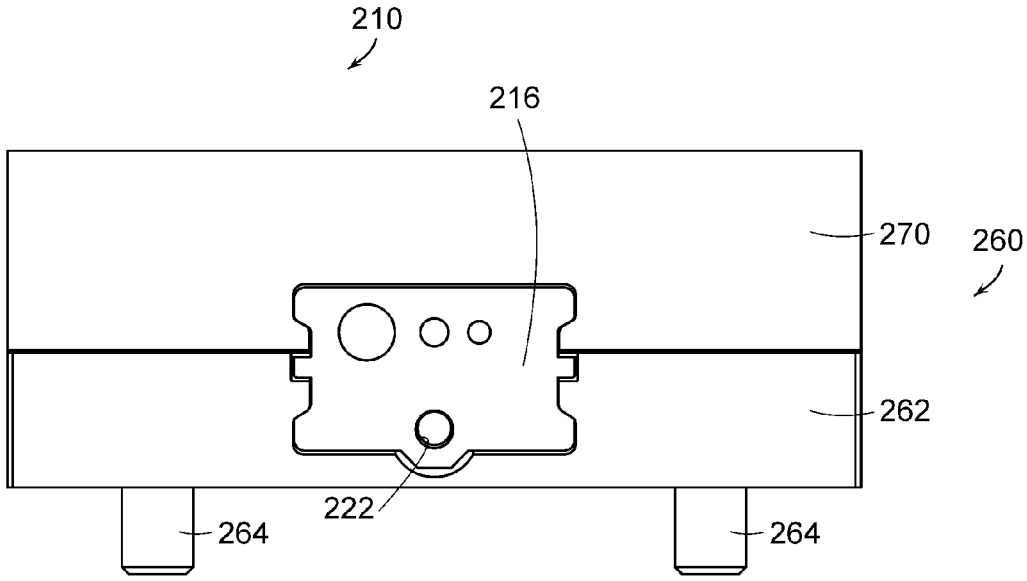
FIG. 21 is a bottom view of the jaw plate and jaw plate adaptor assembly of FIG. 16.

In certain embodiments, referring to FIG. 20, top seal 276 can comprise a two-part seal positioned within recess or groove 271 surrounding clearance hole 275 wherein top seal 276 can permit tool 140 to be inserted therethrough. In at least one embodiment, top seal 276 can include two flexible flapper portions 277 which can be configured to cover, or at least substantially cover, aperture 275 when a tool is not inserted through and, although not illustrated, flex downwardly when a tool is inserted therethrough. Further to the above, jaw plate 210 can further include a recess, or groove, 279 which can be sized and configured to at least partially retain bottom seal 278 in position. In at least one such embodiment, bottom seal 278 can comprise an O-ring wherein at least a portion of its circumference is captured by lip 273 extending around the perimeter recess 279. In various embodiments, bottom seal 278 can be configured to be compressed between top surface 269 of adaptor plate 262 and overhang portion 274 of jaw plate 210 so as to prevent, or at least inhibit, debris or dust from entering into aperture 222 from a path intermediate jaw plate 210 and adaptor plate 262.

Figure 22:
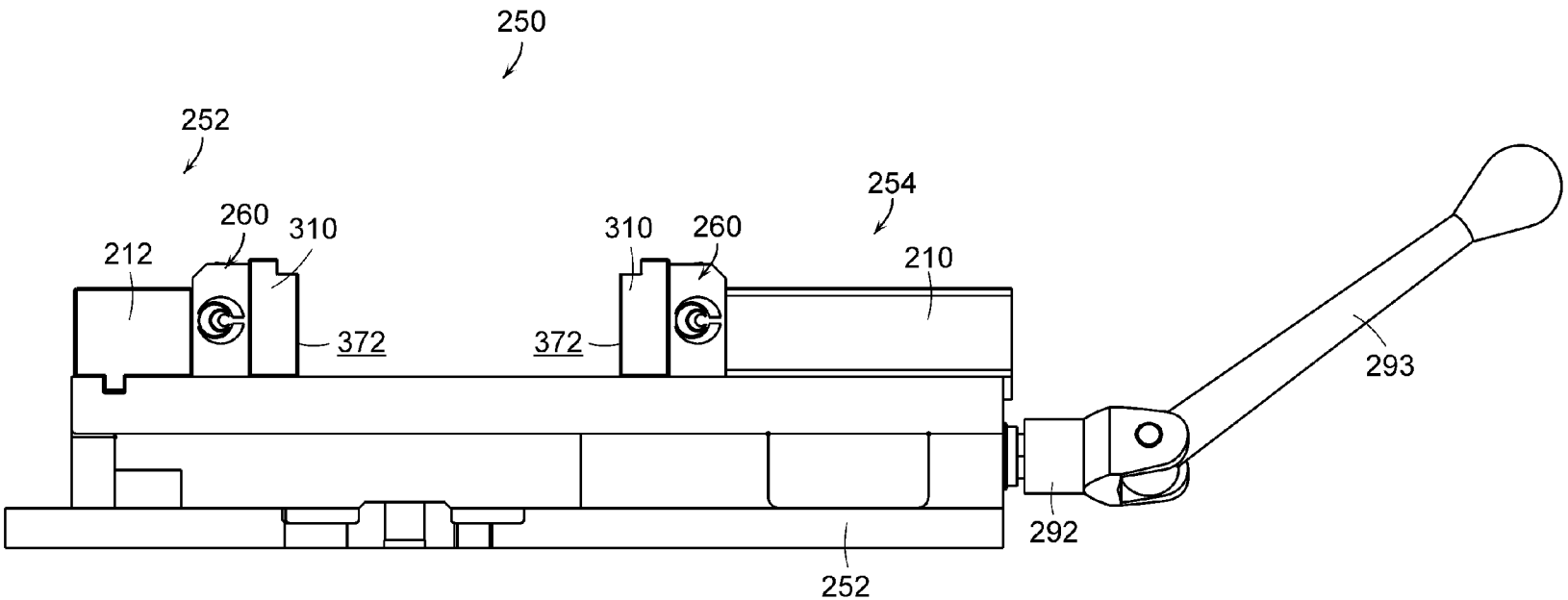
FIG. 22 is an elevational view of the workholding device of FIG. 10 having a different set of jaw plates assembled thereto in accordance with an alternative embodiment of the present invention.
Figure 23:
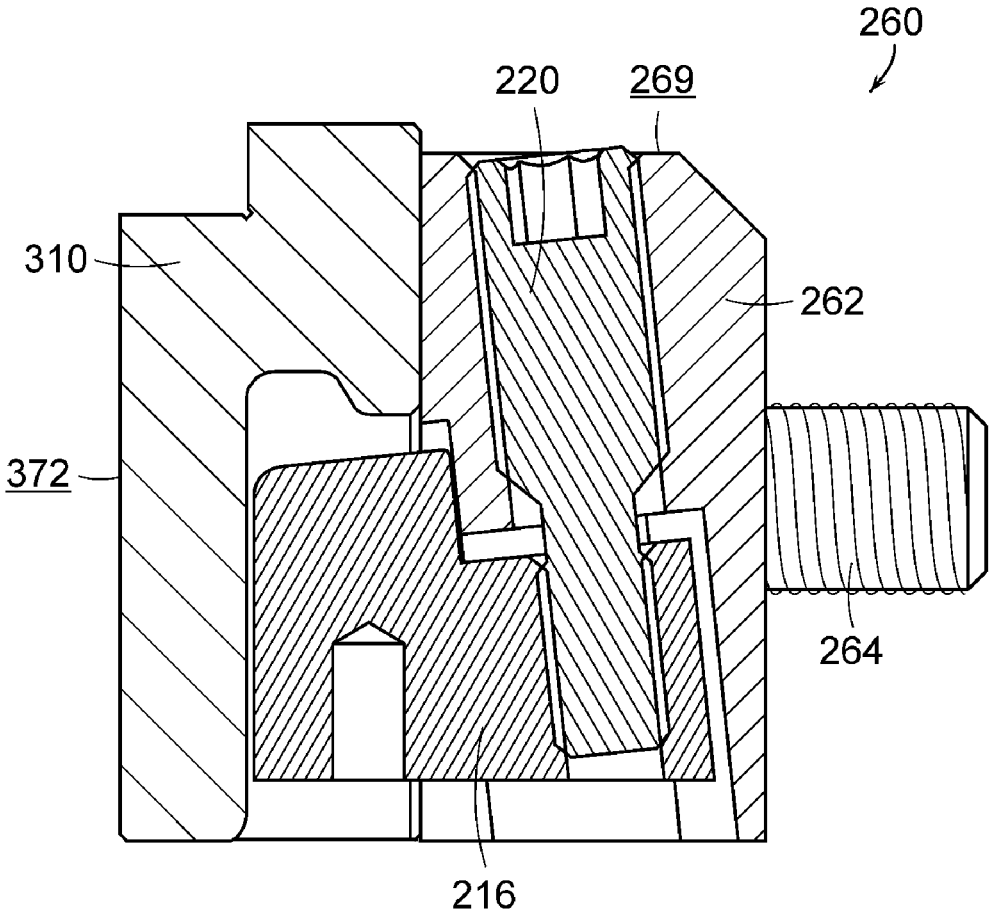
FIG. 23 is a cross-sectional view of a jaw plate and jaw plate adaptor assembly of FIG. 22.
Figure 24:
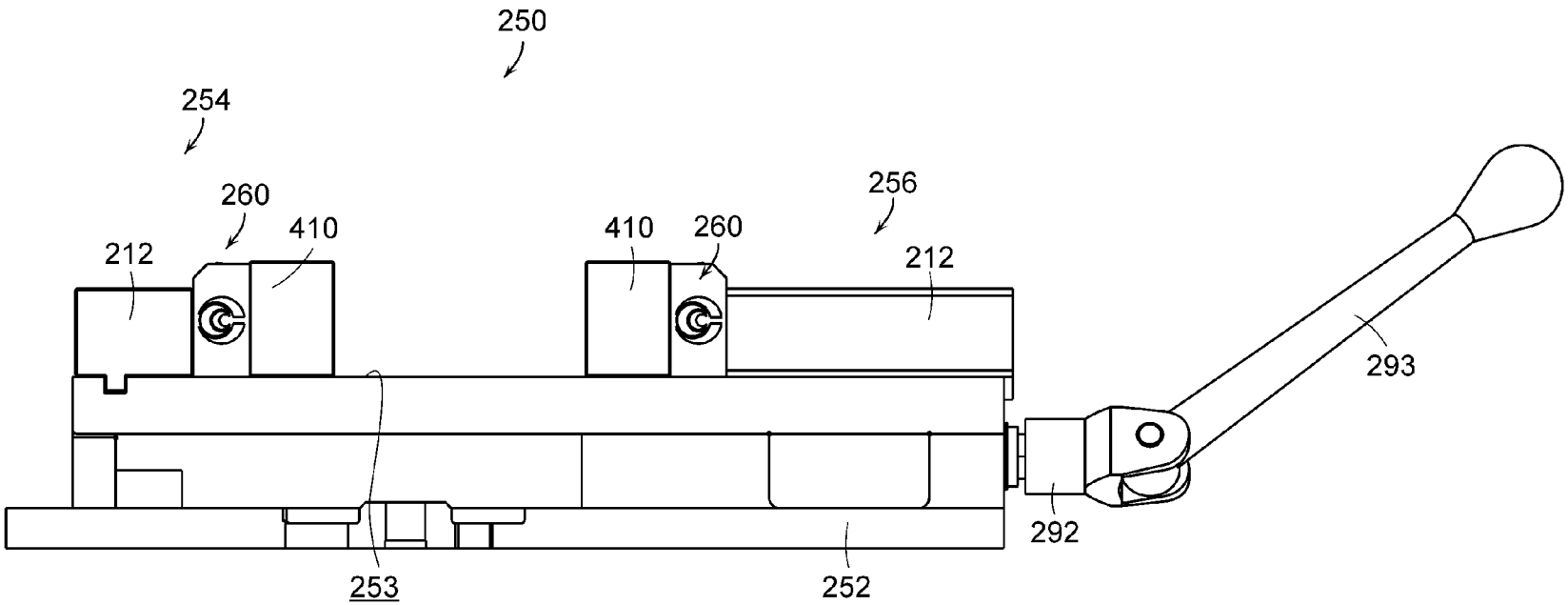
FIG. 24 is an elevational view of the workholding device of FIG. 10 having a different set of jaw plates assembled thereto in accordance with an alternative embodiment of the present invention.
Figure 25:
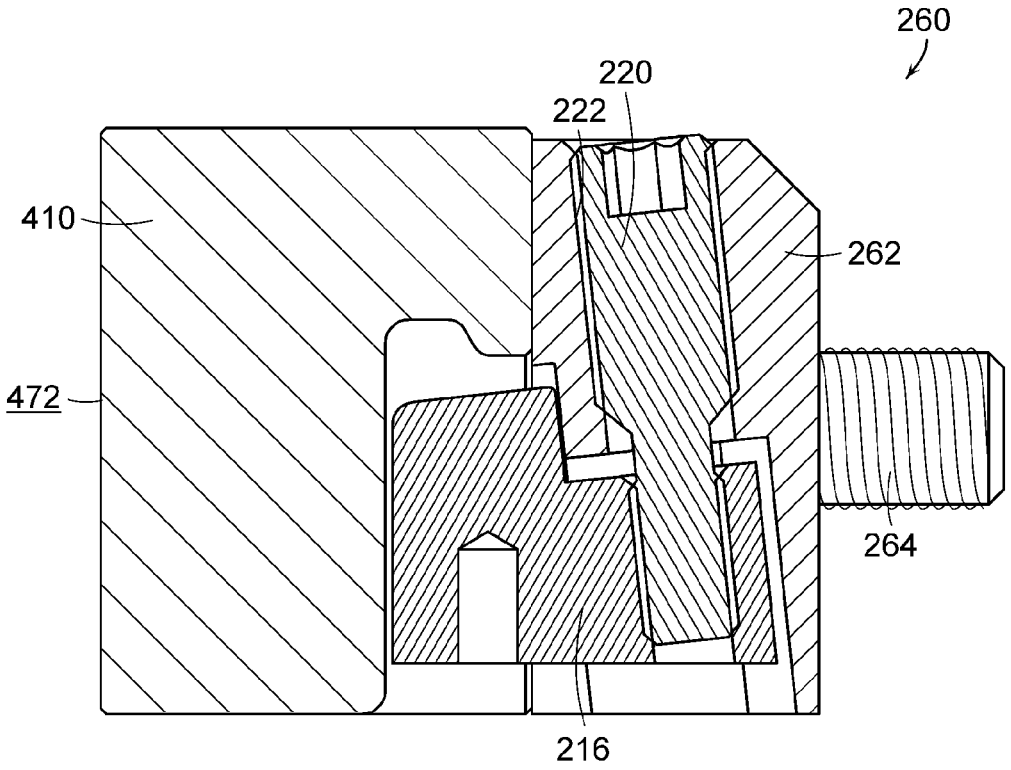
FIG. 25 is a cross-sectional view of a jaw plate and jaw plate adaptor assembly of FIG. 24.
Figure 26:
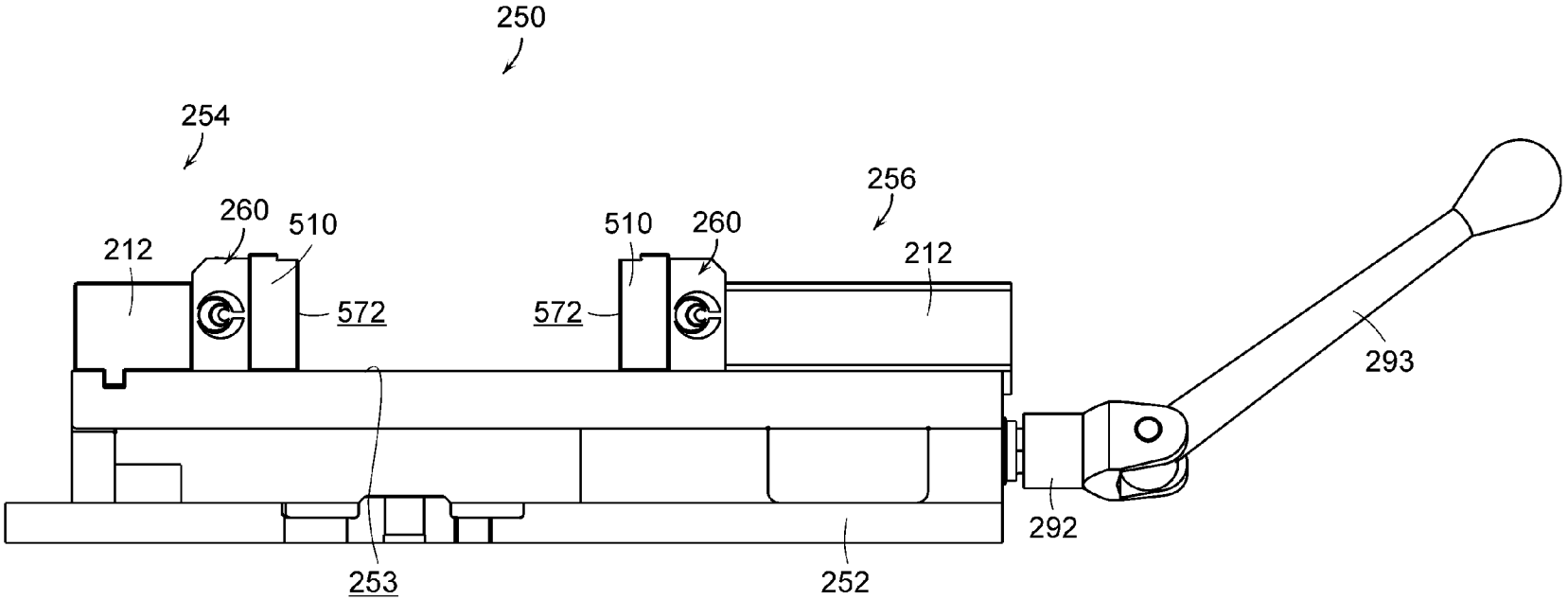
FIG. 26 is an elevational view of the workholding device of FIG. 10 having yet another different set of jaw plates assembled thereto in accordance with an alternative embodiment of the present invention.

As outlined above, an adaptor assembly 260 can be configured to retain a variety of jaw plates to a jaw member. In various embodiments, referring to FIGS. 22 and 23, an adaptor assembly 260 can be configured to retain a jaw plate 310 to one of jaw members 254 and 256, for example. In at least one such embodiment, jaw plate 310, similar to jaw plates 110 or 210, for example, can be removably attached to the jaw member via slide 116 or slide 216, for example. In certain embodiments, jaw plate 310 can comprise a different configuration than jaw plates 110 and 210, among others, and can include a workpiece contacting surface 372, for example. Similar to the above, referring to FIGS. 24-26, an adaptor assembly 260 can be configured to removably retain a jaw plate 410 and/or a jaw plate 510 to a jaw member, such as jaw members 254 and/or 256, for example, wherein jaw plates 410 and 510 can comprise different configurations including different workpiece contacting surfaces 472 and 572, respectively. Although various embodiments are illustrated wherein jaw members 254 and 256 have the same, or similar, jaw plates removably attached thereto, embodiments are envisioned in which jaw members 254 and 256, for example, have different jaw plates attached thereto.

In various embodiments, further to the above, a workholding apparatus can include one or more retention members configured to releasably hold a jaw plate in position. In at least one embodiment, referring to FIGS. 39-46, a workholding apparatus can include a jaw plate adaptor 662, cam slide 616, and actuator 620 which can be configured to move and/or retain jaw plate 610 in position. In various embodiments, jaw plate adaptor 662, cam slide 616, actuator 620, and/or jaw plate 610 can include the same, or similar, features as the devices disclosed throughout the present application and, as a result, the description of such features are not repeated herein. In certain embodiments, jaw plate adaptor 662 can include a retention member, such as retention member 613, for example, which can be configured to engage jaw plate 610 when jaw plate 610 is assembled to jaw plate adaptor 662. In at least one such embodiment, jaw plate 610 can include at least one slot (not illustrated) configured to closely receive retention member 613 wherein, in certain embodiments, retention member 613 can be press-fit within, or snugly fit within, the slot. In certain embodiments, the interaction between retention member 613 and the sidewalls of the slot can prevent, or at least limit, relative movement between jaw plate 610 and jaw plate adaptor 662 in the side-to-side, or transverse, direction, for example. In at least one such embodiment, referring to FIG. 39, jaw plate adaptor 662 can include at least one aperture, such as aperture 665, for example, which can be configured to receive retention member 613 therein. In at least one such embodiment, retention member 613 can be press-fit within aperture 665.

Figure 39:
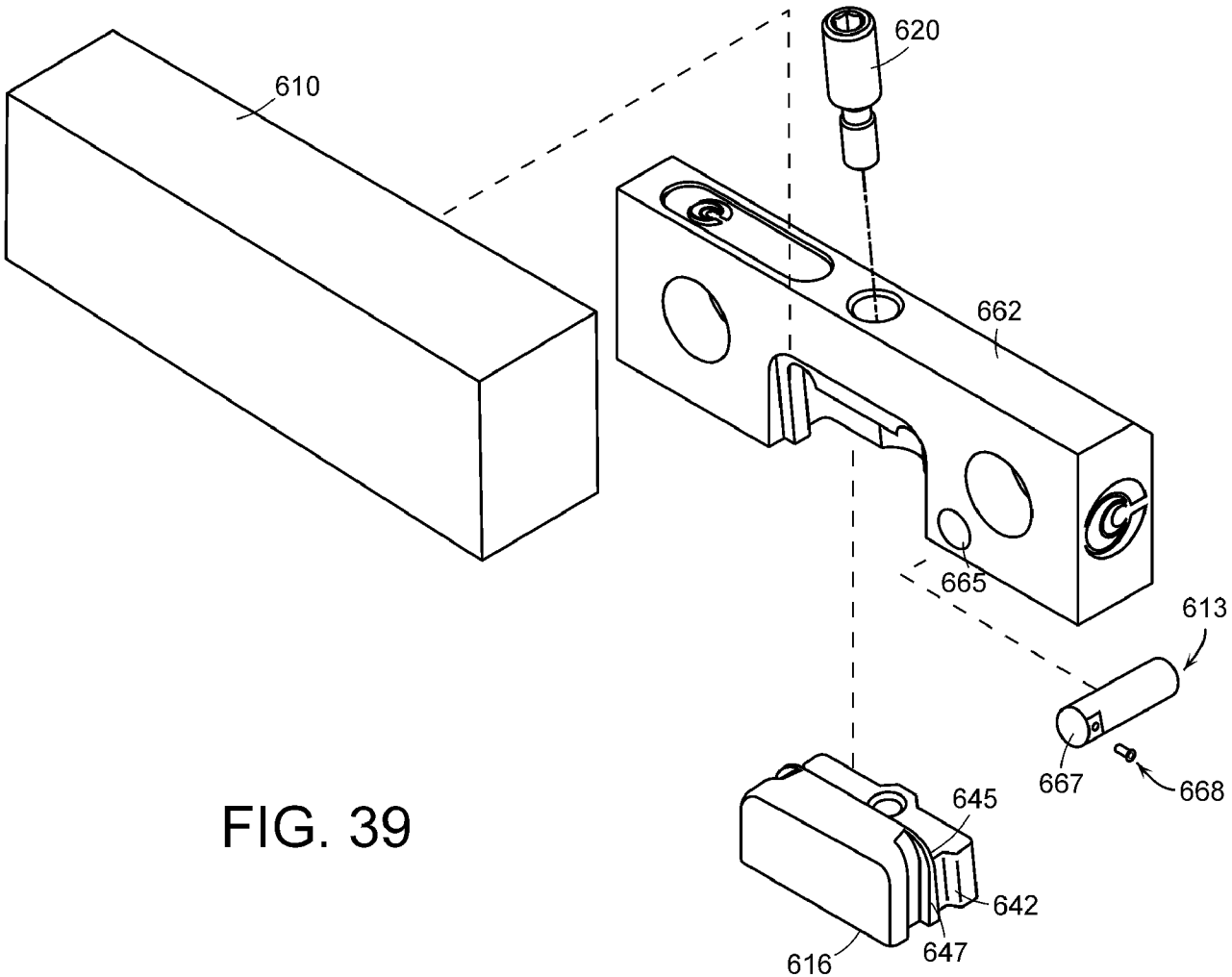
FIG. 39 is an exploded assembly view illustrating a jaw plate adaptor, a cam slide, an actuator for moving the slide, a jaw plate, and a retention member configured to removably hold the jaw plate relative to the jaw plate adaptor.
Figure 40:
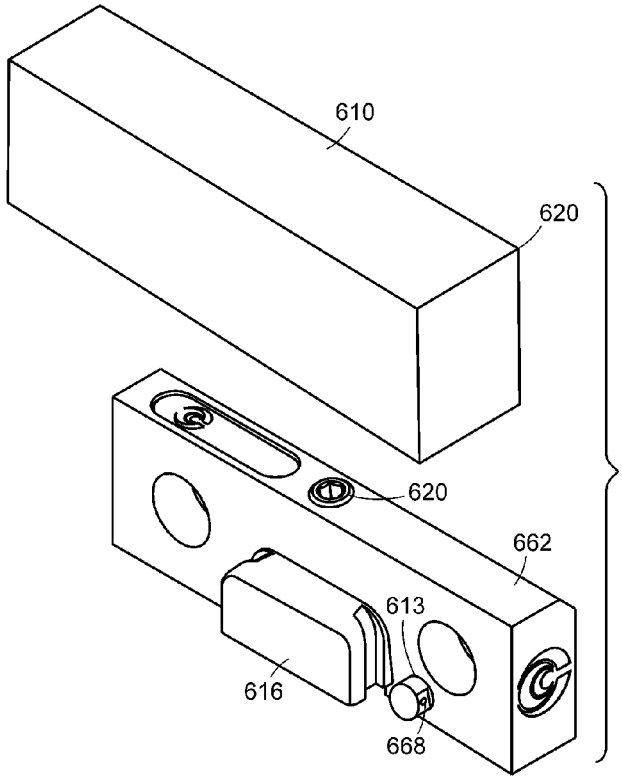
FIG. 40 is a perspective view of the jaw plate of FIG. 39 unattached to the jaw plate adaptor of FIG. 39.
Figure 41:
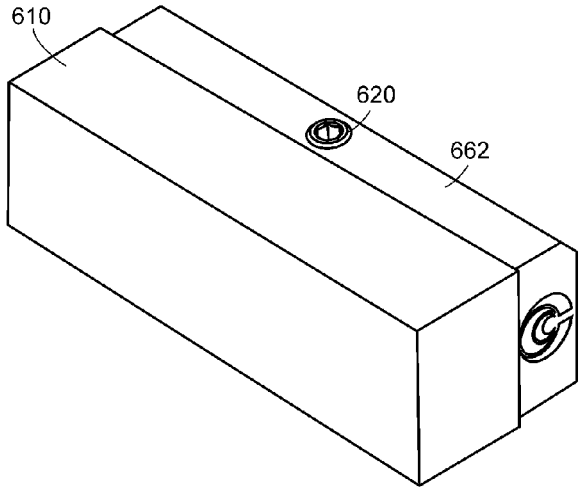
FIG. 41 is a perspective view of the jaw plate of FIG. 39 attached to the jaw plate adaptor of FIG. 39.
Figure 43:
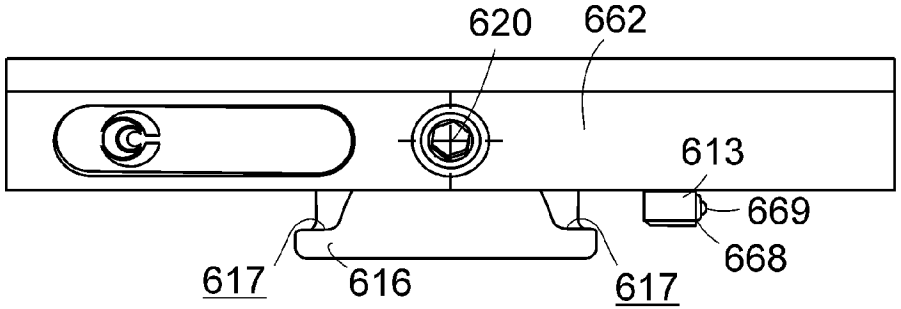
FIG. 43 is a top view of the assembly of FIG. 42.
Figure 42:
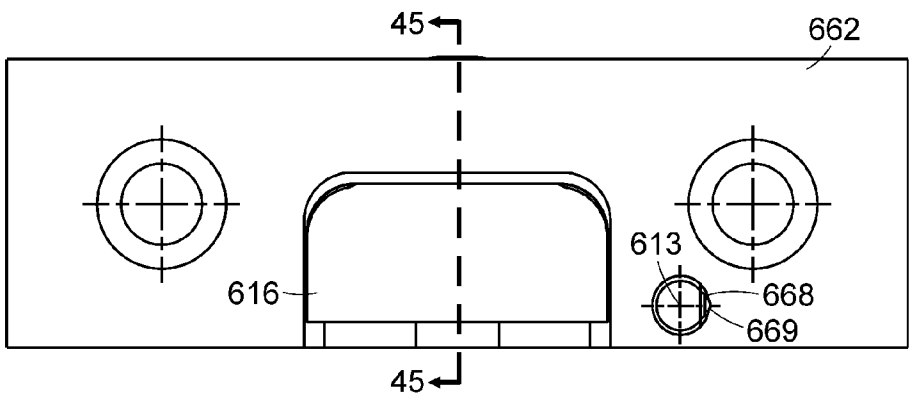
FIG. 42 is an elevational view of an assembly comprising the jaw plate adaptor, cam slide, actuator, and retention member of FIG. 39.
Figure 44:
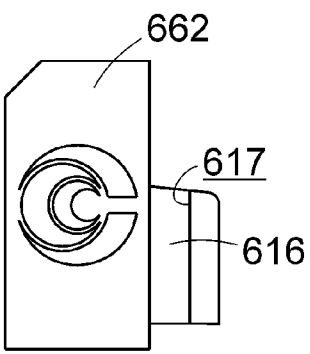
FIG. 44 is a side view of the assembly of FIG. 42.
Figure 45:
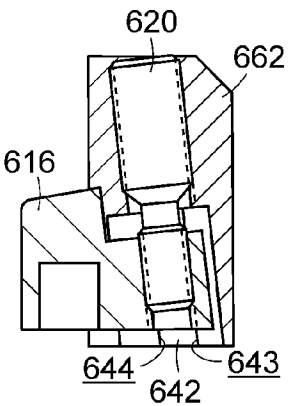
FIG. 45 is a cross-sectional view of the assembly of FIG. 42 taken along line 45-45 in FIG. 42.
Figure 46:
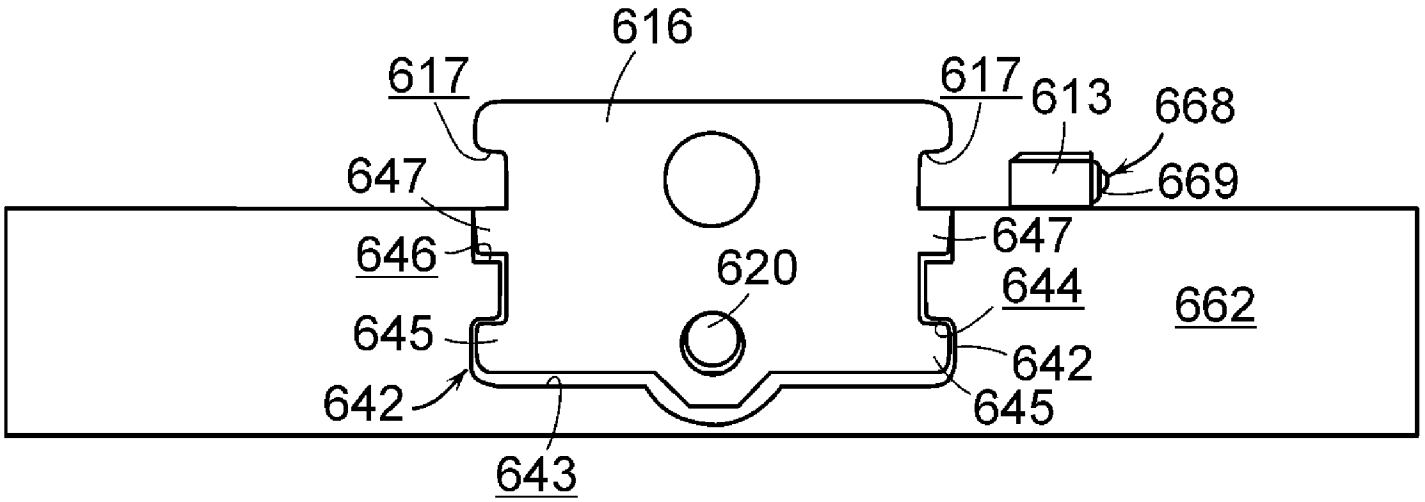
FIG. 46 is a bottom view of the assembly of FIG. 42.

In various embodiments, further to the above, retention member 613 can include one or more biasing members which can be configured to engage jaw plate 610, for example. In at least one embodiment, retention member 613 can include at least one detent member, or plunger, 668 which can be configured to engage one or more of the sidewalls of the slot defined within jaw plate 610 described above. Referring to FIGS. 39 and 40, retention member 613 can include at least one aperture 667 which can be configured to receive detent member 668. In certain embodiments, detent member 668 can be press-fit within aperture 667. Referring now to FIGS. 42 and 43, detent member 668 can include at least one ball 669 which can be biased radially outwardly by a spring (not illustrated) positioned within detent member 668. In use, a sidewall of the jaw plate slot can be configured to engage ball 669 when jaw plate 610 is assembled to jaw plate adaptor 662 such that ball 669 is displaced radially inwardly by the sidewall. When ball 669 is moved inwardly, ball 669 can compress the detent member spring such that the spring can apply an outwardly-directed biasing force to ball 669. In at least one embodiment, the biasing force can be transmitted to jaw plate 610 via ball 669 such that the biasing force can create a friction force between jaw plate 610 and ball 669, and/or any other suitable portion of retention member 613. Stated another way, detent mechanism 668 can be configured such that one side of retention member 613 is in contact with one sidewall of the jaw plate slot and that ball 669 is in contact with the opposite sidewall. As a result of the above, detent mechanism 668 can be configured to reduce or eliminate slop, if any, between retention member 613 and the slot within jaw plate 610 and thereby reduce or eliminate relative movement, or play, between jaw plate 610 and jaw plate adaptor 662. In the event that an operator, for example, applies a sufficient force to jaw plate 610, the operator can overcome the friction force between jaw plate 610 and retention member 613 and remove jaw plate 610 from jaw plate adaptor 662.

In certain embodiments, a retention member can be used in conjunction with a sufficient angle defined between surfaces 117 and 144 (FIG. 9), as described above, in order to control the side-to-side, or transverse, positioning of a jaw plate. In various other embodiments, a retention member can be used in lieu of such previously-described features. In at least one such embodiment, referring to FIGS. 42-46, jaw plate adaptor 662 can include at least one track 642 configured to receive one or more flanges 645 extending from slide 616. Similar to the above, tracks 642 can be configured to guide slide 616 via flanges 645 when actuator 620 is used to move slide 616 upwardly and/or downwardly along a predetermined path. Also similar to the above, each track 642 can include a back surface 643 and a front surface 644 which can be configured to guide and/or contain flanges 645. Further to the above, slide 616 can include at least one flange 647 and jaw plate adaptor 662 can include at least one front surface 646 which can be configured to guide slide 616. When slide 616 is moved inwardly and downwardly as described above, lock surface 617 can be configured to contact a jaw plate, such as jaw plate 610, for example, and move the jaw plate inwardly. In contrast to surfaces 117 and 144 of the embodiment illustrated in FIG. 9, surfaces 617 and 644 of the embodiment illustrated in FIG. 46 can be parallel, or at least substantially parallel to one another.

In various alternative embodiments, referring to FIGS. 27-38, a jaw member can include jaw plate 110', body portion 112', and lock assembly 114'. In use, jaw plate 110' can be positioned against, or in close opposition to, body portion 112' such that cam slide 116' of lock assembly 114' can be slid into recess 118' in jaw plate 110'. In various embodiments, referring to FIGS. 27-29, body portion 112' can include alignment guide, or precision locator stop, 113' and, in addition, jaw plate 110' can include alignment slot 119' wherein slot 119' can be configured to receive guide 113' and substantially align jaw plate 110' relative to body portion 112'. In at least one embodiment, lock assembly 114' can further include cam actuator 120' rotatably received within aperture 122' in body portion 112' wherein actuator 120' can be rotated to move cam slide 116' between a first position and a second position in order to move at least a portion of cam slide 116' into cavity 118'. In various embodiments, cam actuator 120' can be rotated more than one revolution in order to move cam slide 116' between its first and second positions and secure the jaw plate to the jaw member. In at least one alternative embodiment, cam actuator 120' can be rotated less than one full revolution to move cam slide 116' between its first and second positions. In either event, as described in greater detail below, lock assembly 114' can further include drive link 124' which can operably connect actuator 120' with cam slide 116' such that the rotation of actuator 120' can translate cam slide 116'.

Figure 36:
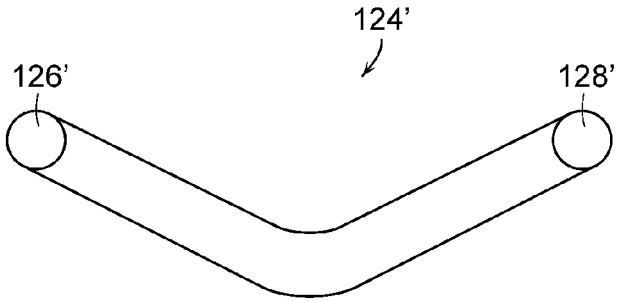
FIG. 36 is a plan view of a drive link of the lock assembly of FIG. 28.
Figure 37:
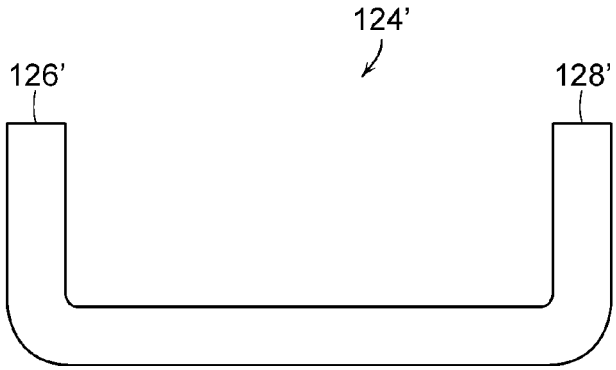
FIG. 37 is an elevational view of the drive link of FIG. 36.
Figure 38:
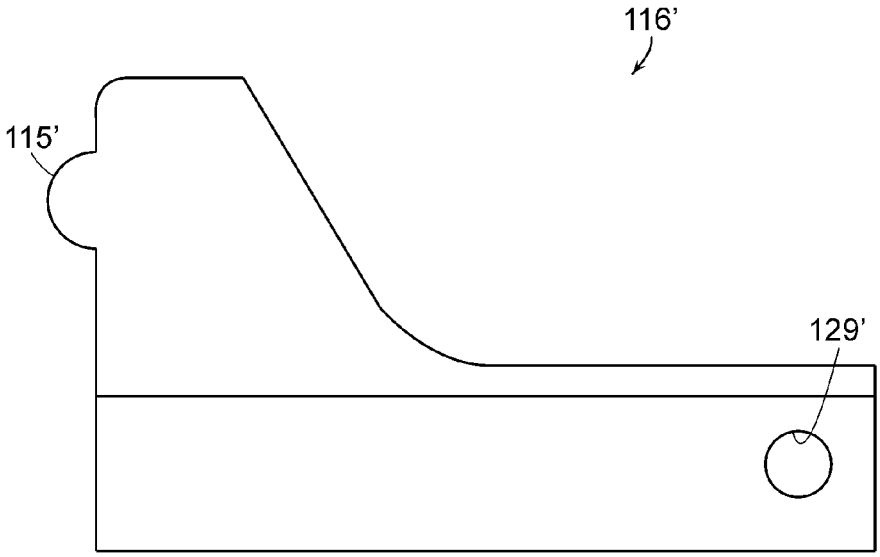
FIG. 38 is a plan view of a cam slide of the lock assembly of FIG. 28.

Further to the above, referring to FIGS. 36 and 37, drive link 124' can comprise a wire having a first end 126' positioned within aperture 127' in actuator 120' (FIGS. 34 and 35) and a second end 128' positioned within aperture 129' in cam slide 116' (FIG. 38). In such embodiments, drive link 124' can be configured such that, when actuator 120' is rotated in a clockwise direction, for example, actuator 120' can displace first end 126' toward recess 118' and, correspondingly, displace drive link 124', second end 128', and cam slide 116' toward recess 118' as well. In various embodiments, referring to FIGS. 28, 33, and 38, cam slide 116' can include a projection, or lock, 115' which can be configured to extend behind lock surface 117' of recess 118' when cam slide 116' is displaced by cam actuator 120'. In at least one such embodiment, lock 115' and lock surface 117' can cooperate to retain jaw plate 110' to body portion 112'. In at least one embodiment, referring to FIG. 38, lock 115' can include an arcuate, or curved, surface which can be configured to abut lock surface 117' and pull jaw plate 110' toward body portion 112'. In order to release jaw plate 110', cam actuator 120' can be rotated in a counter-clockwise direction, for example, to pull cam slide 116' at least partially out of recess 118'. Thereafter, an operator can lift plate 110' upwardly, for example, away from body portion 112'. In at least one embodiment, although not illustrated, cam slide 116', or any other suitable feature of lock assembly 114', can be configured to push jaw plate 110' away from body portion 112'.

Figure 27:
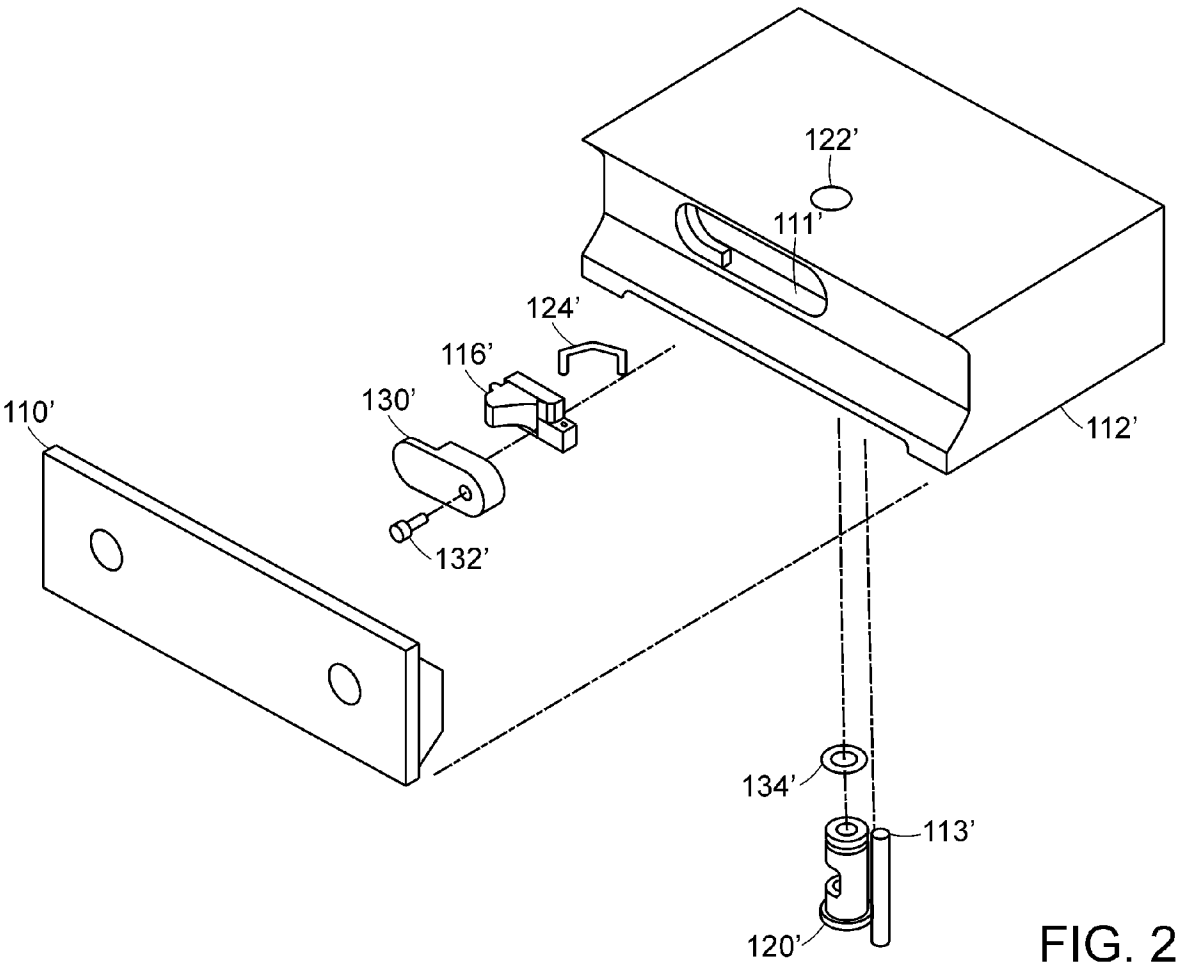
FIG. 27 is an exploded view of a jaw member in accordance with an embodiment of the present invention.
Figure 28:
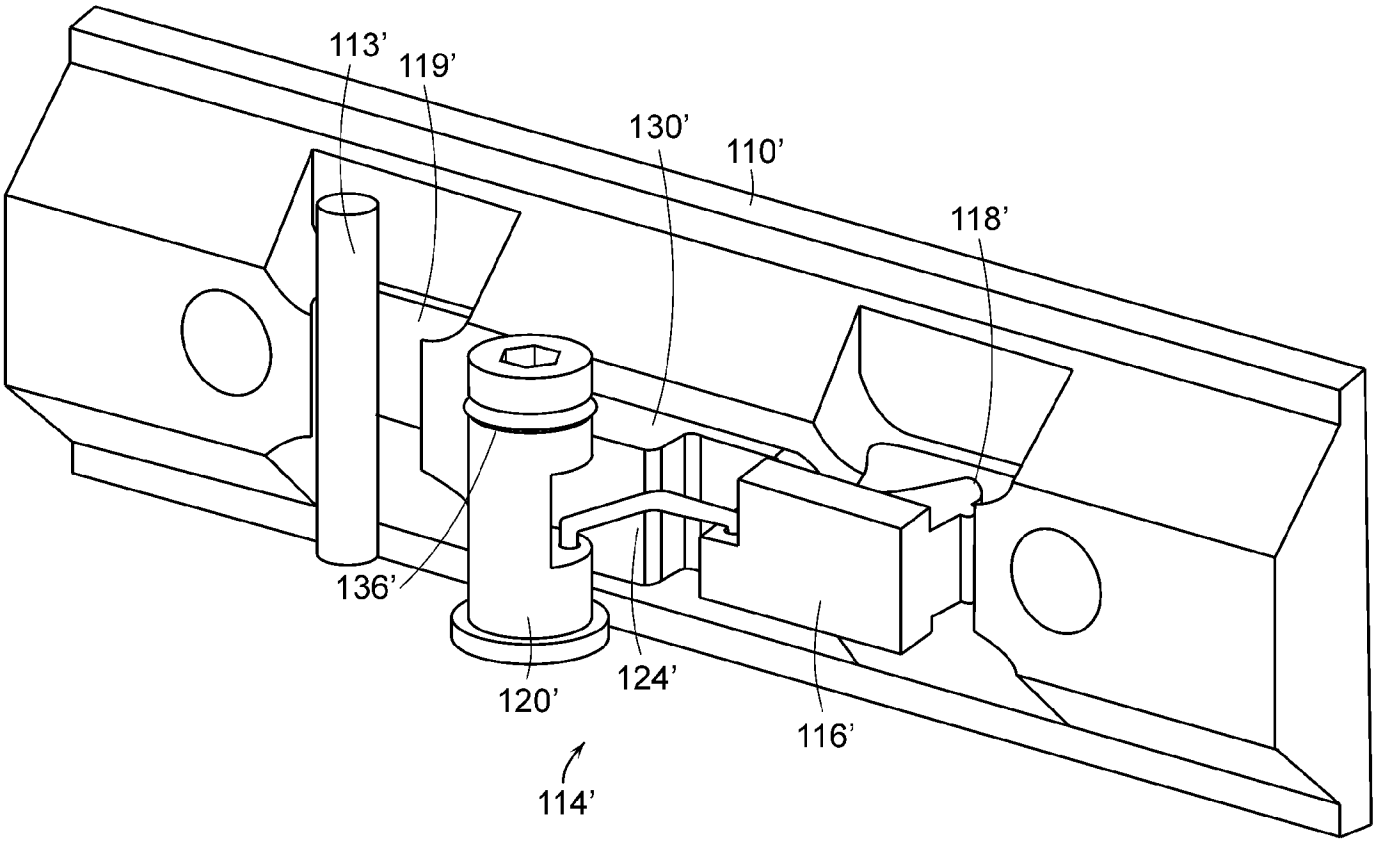
FIG. 28 is a perspective view of a lock assembly of the jaw member of FIG. 27 configured to retain a jaw plate to a base portion of the jaw member.
Figure 29:
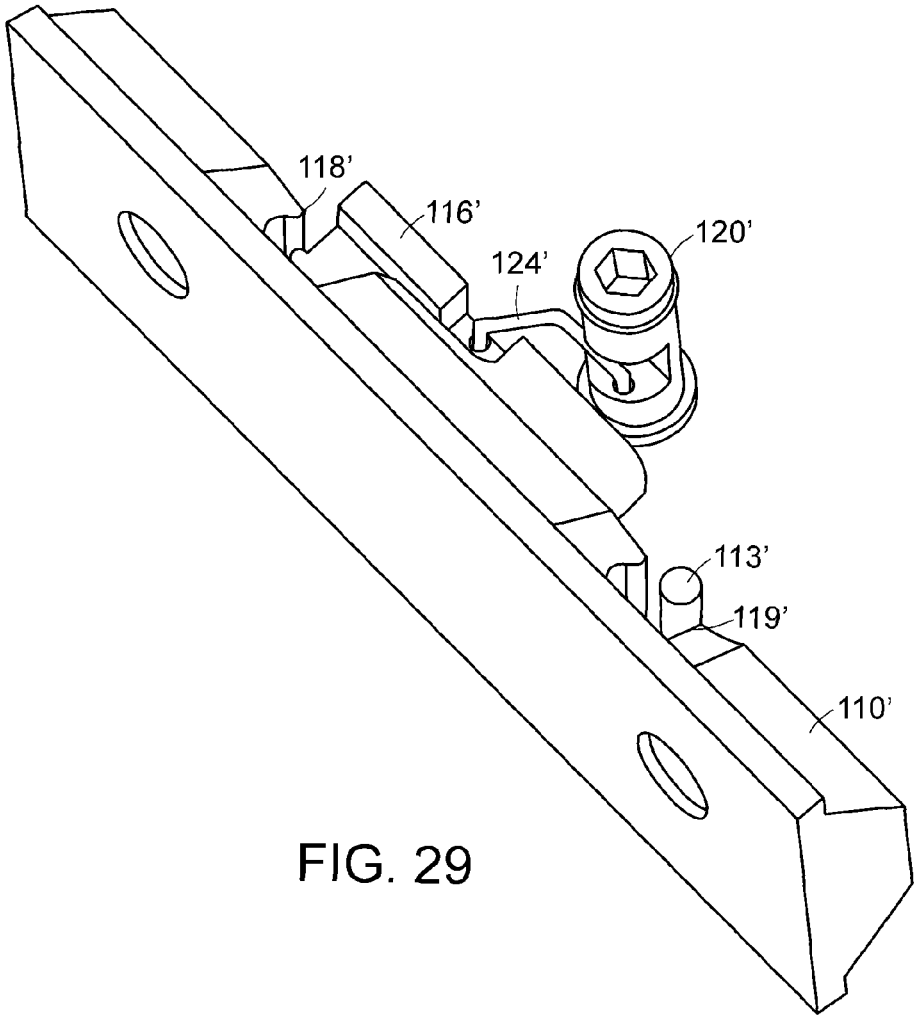
FIG. 29 is another perspective view of the lock assembly and jaw plate of FIG. 27.
Figure 30:
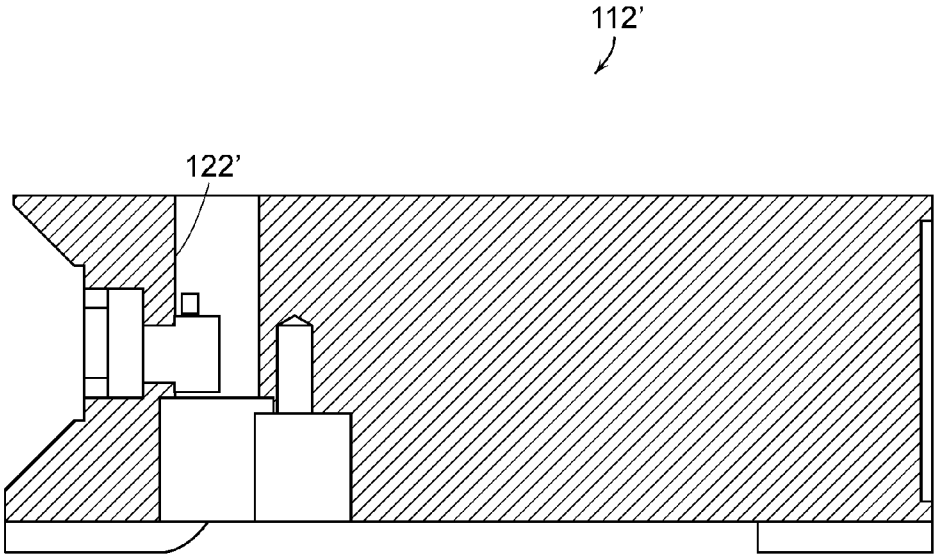
FIG. 30 is a cross-sectional view of the base portion of the jaw member of FIG. 27.
Figure 31:
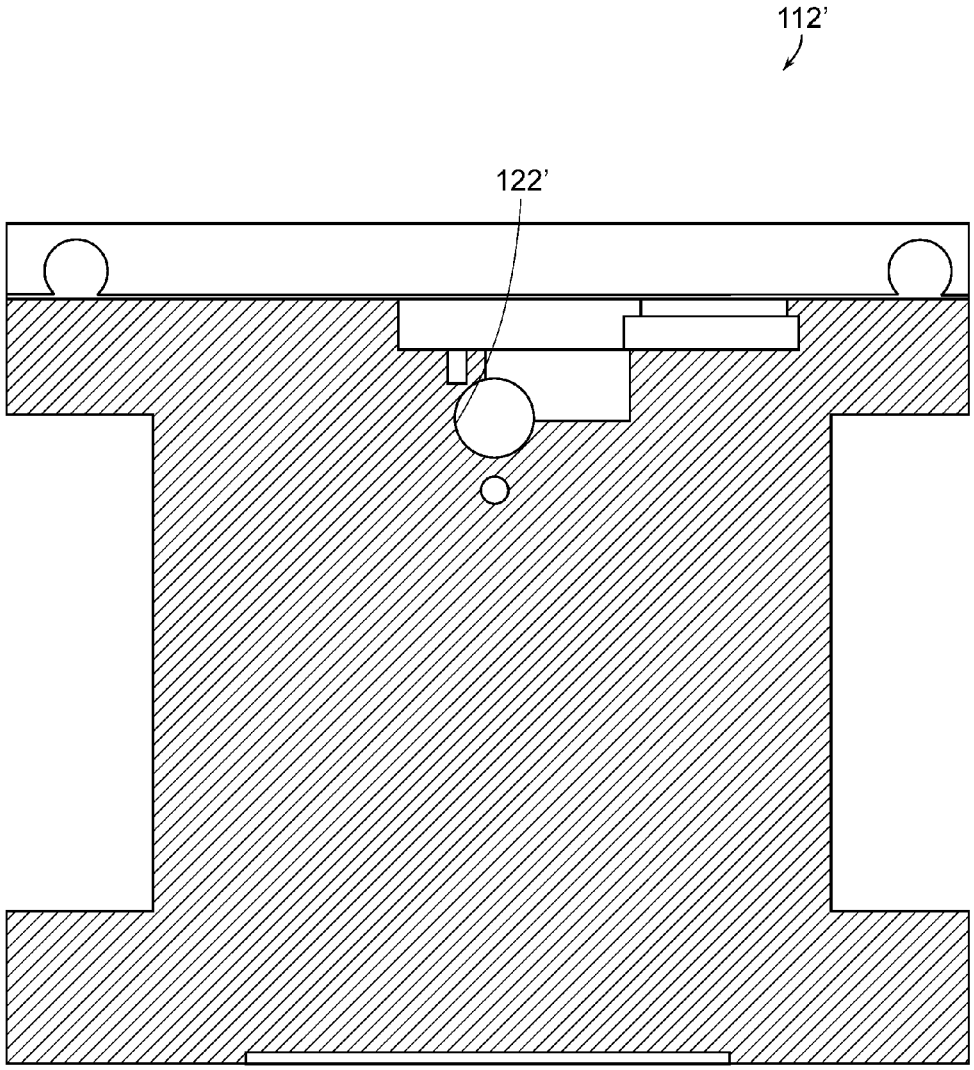
FIG. 31 is another cross-sectional view of the base portion of FIG. 27.
Figure 32:
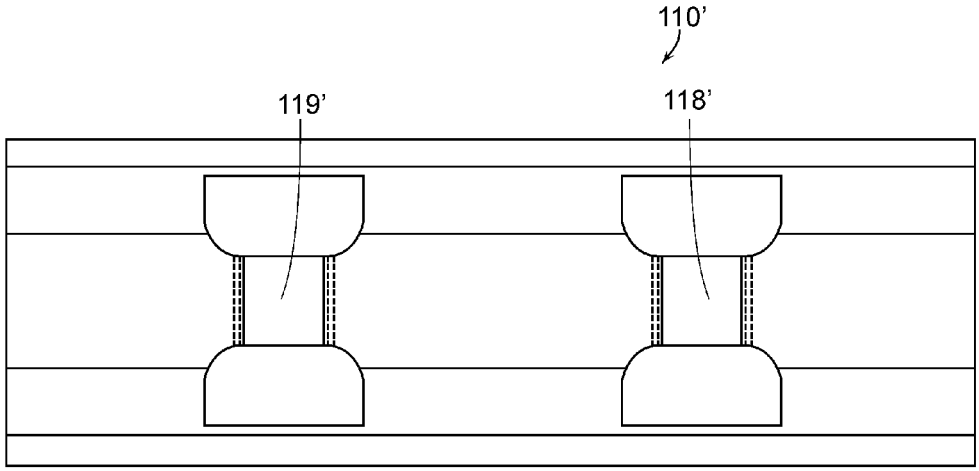
FIG. 32 is a rear elevational view of the jaw plate of FIG. 27.
Figure 33:
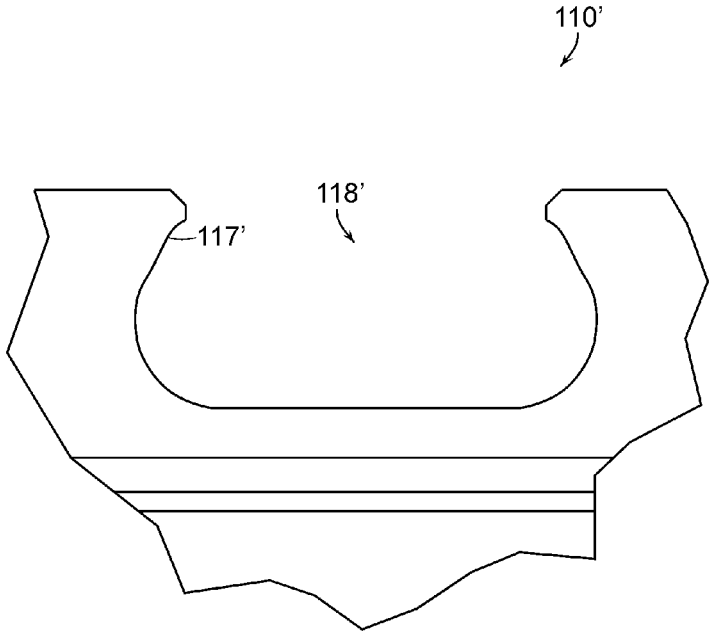
FIG. 33 is partial top view of the jaw plate of FIG. 27.
Figure 34:
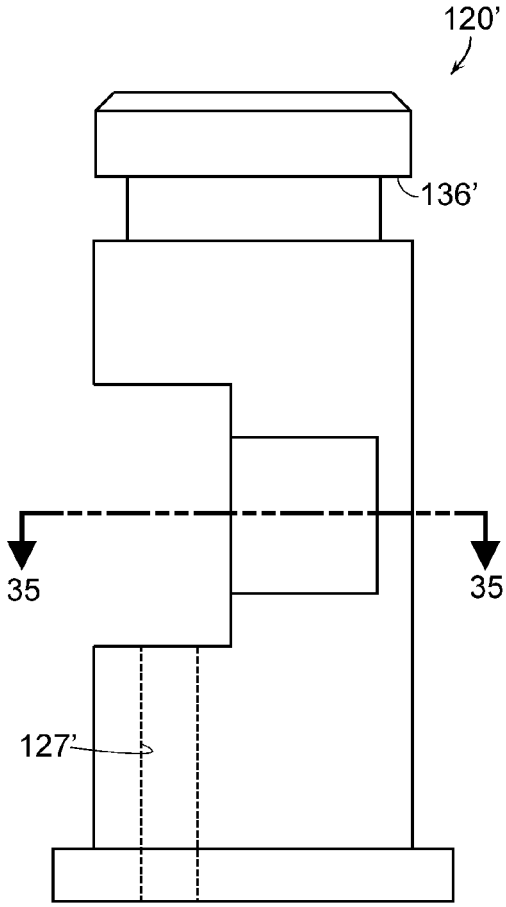
FIG. 34 is an elevational view of a cam actuator of the lock assembly of FIG. 28.
Figure 35:
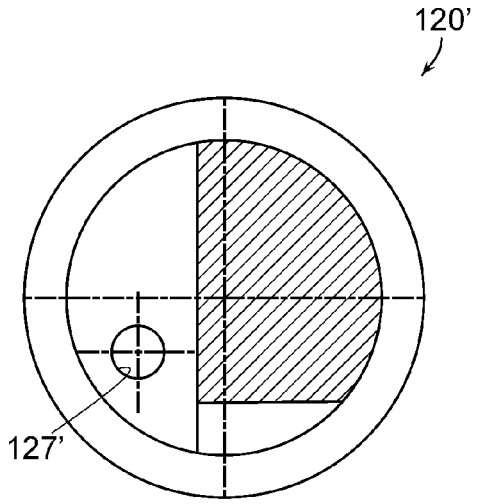
FIG. 35 is a cross-sectional view of the cam actuator of FIG. 34 taken along line 35-35 in FIG. 34.

In various embodiments, referring to FIG. 27, body portion 112' can include recess 111' which can be configured to slidably receive at least a portion of slide cam slide 116' therein. In at least one embodiment, recess 111' can define a path for, or guide, cam slide 116' as it is moved relative to body portion 112'. The jaw member can also include a cover plate, such as cover plate 130', for example, mounted to body portion 112' by fastener 132'. In various embodiments, cover plate 130' can be configured to cover at least a portion of cam slide 116' and recess 111' in order to prevent, or at least inhibit, debris, for example, from entering into body portion 112'. Similarly, referring to FIG. 27, the jaw member can include a seal, such as o-ring 134', for example, which can sealingly engage cam actuator 120' and aperture 122' in body portion 112' in order to prevent, or at least inhibit, debris, from entering into body portion 112'. In at least one embodiment, referring to FIGS. 28 and 34, actuator 120' can include an annular recess, or seat, 136' which can be configured to receive o-ring 134' (FIG. 27). In various embodiments, although not illustrated, the jaw member can further include a retaining ring, for example, for holding cam actuator 120' in aperture 122'. In at least one such embodiment, similar to the above, actuator 120' can include a recess, or seat, for receiving the retaining ring.

In various embodiments, a retro-fit kit can be provided which converts a typical jaw member having a fastened jaw plate into the cam-locked jaw member and jaw plate of the present invention. In further embodiments, a workholding device incorporating the present invention can include a fixed jaw member and two movable jaw members. A workholding device having two movable jaw members and a fixed jaw member is described and illustrated in U.S. Pat. No. 5,022,636, entitled WORKHOLDING APPARATUS, which issued on Jun. 11, 1991, the content of which is hereby incorporated by reference herein.

While this invention has been described as having exemplary designs, the present invention may be further modified within the spirit and scope of the disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A device for holding a workpiece, said device comprising:

a base including a workpiece support surface;

a first jaw member; and a second jaw member, wherein one of said first jaw member and said second jaw member is movable relative to the other of said first jaw member and said second jaw member, wherein said first jaw member and said second law member are configured to hold a workpiece therebetween, said second jaw member including:

a jaw base;

a removable jaw plate;

a slide movable between a first position and a second position, wherein said slide is configured to move said jaw plate toward said jaw base and said workpiece support surface when said slide is moved between said first position and said second position; and an actuator configured to move said slide between said first position and said second position;

wherein said slide is configured to be moved along a slide axis between said first position and said second position, and wherein said actuator is threadably engaged with said slide, wherein said actuator defines an actuator axis, and wherein said slide axis and said actuator axis are substantially parallel.

2. The device of claim 1, wherein said slide is configured to position said jaw plate against said workpiece support surface.

3. The device of claim 1, wherein said second position is closer to said workpiece support surface than said first position.

4. The device of claim 1, wherein said slide axis is oriented at an approximately 84 degree angle with respect to said workpiece support surface.

5. The device of claim 1, further comprising a jaw plate adaptor mounted to said jaw base, wherein said actuator and said slide are at least partially mounted within said jaw plate adaptor.

6. The device of claim 1, wherein said second jaw member further includes a detent member configured to engage said jaw plate and releasably hold said jaw plate in position.

7. The device of claim 1, further comprising a guide post extending from said jaw base, wherein said jaw plate comprises a slot defined therein, and wherein said slot is configured to receive said guide post when said jaw plate is assembled to said jaw base.

8. A device for holding a workpiece, said device comprising:

a base including a workpiece support surface;

a first jaw member; and a second jaw member, wherein one of said first jaw member and said second jaw member is movable relative to the other of said first jaw member and said second jaw member, wherein said first jaw member and said second jaw member are configured to hold a workpiece therebetween, said second jaw member including:

a law base;

a removable jaw plate;

a slide movable between a first position and a second position, wherein said slide is configured to move said law plate in a direction which is neither parallel to nor perpendicular to said workpiece support surface; and an actuator configured to move said slide between said first position and said second position, wherein said slide is configured to be moved along a slide axis between said first position and said second position, wherein said actuator is threadably engaged with said slide, wherein said actuator defines an actuator axis, and wherein said slide axis and said actuator axis are substantially parallel.

9. The device of claim 8, wherein said slide is configured to position said jaw plate against said workpiece support surface.

10. The device of claim 8, wherein said second position is closer to said workpiece support surface than said first position.

11. The device of claim 8, wherein said slide axis is oriented at an approximately 84 degree angle with respect to said workpiece support surface.

12. The device of claim 8, further comprising a jaw plate adaptor mounted to said jaw base, wherein said actuator and said slide are at least partially mounted within said jaw plate adaptor.

13. The device of claim 8, wherein said second jaw member further includes a detent member configured to engage said jaw plate and releasably hold said jaw plate in position.

14. The device of claim 8, further comprising a guide post extending from said jaw base, wherein said jaw plate comprises a slot defined therein, and wherein said slot is configured to receive said guide post when said jaw plate is assembled to said jaw base.

15. A device for holding a workpiece, said device comprising:

a base including a workpiece support surface;

a first jaw member; and a second jaw member, wherein one of said first law member and said second jaw member are movable relative to the other of said first law member and said second jaw member, wherein said first jaw member and said second jaw member are configured to hold a workpiece therebetween, said second jaw member including:

a jaw base;

a slide movable along a slide axis, wherein said slide is configured to move a jaw plate toward said jaw base and said workpiece support surface; and an actuator configured to move said slide along said slide axis, wherein said actuator is threadably engaged with said slide, wherein said actuator defines an actuator axis, and wherein said slide axis and said actuator axis are substantially parallel.

16. The device of claim 15, wherein said slide axis is oriented at an approximately 84 degree angle with respect to said workpiece support surface.

17. The device of claim 15, wherein said slide is configured to position the jaw plate against said workpiece support surface.

18. The device of claim 15, wherein said second jaw member further includes a detent member configured to engage the jaw plate and releasably hold the jaw plate in position.

19. The device of claim 15, further comprising said jaw plate and a guide post extending from said jaw base, wherein said jaw plate comprises a slot defined therein, and wherein said slot is configured to receive said guide post when said jaw plate is assembled to said jaw base.

20. A device for holding a workpiece, said device comprising:

a base including a workpiece support surface;

a first jaw member; and a second jaw member, wherein one of said first jaw member and said second jaw member is movable relative to the other of said first jaw member and said second jaw member, wherein said first jaw member and said second jaw member are configured to hold a workpiece therebetween, said second jaw member including:

a jaw base;

a removable jaw plate;

a slide movable between a first position and a second position, wherein said slide is configured to move said jaw plate toward said jaw base when said slide is moved between said first position and said second position;

an actuator configured to move said slide between said first position and said second position;

a tool-receiving aperture substantially aligned with said actuator; and a seal configured to inhibit debris from entering into said tool-receiving aperture but permit a tool to be inserted therethrough.

21. The device of claim 20, wherein said slide is configured to position said jaw plate against said workpiece support surface.

22. The device of claim 20, wherein said second jaw member further includes a detent member configured to engage said jaw plate and releasably hold said jaw plate in position.

23. The device of claim 20, further comprising a guide post extending from said jaw base, wherein said jaw plate comprises a slot defined therein, and wherein said slot is configured to receive said guide post when said jaw plate is assembled to said jaw base.

24. A device for holding a workpiece, said device comprising:

a base including a workpiece support surface;

a first jaw member; and a second jaw member, wherein one of said first jaw member and said second jaw member is movable relative to the other of said first jaw member and said second jaw member, wherein said first jaw member and said second jaw member are configured to hold a workpiece therebetween, said second jaw member including:

a jaw base;

a removable jaw plate;

a slide movable between a first position and a second position, wherein said slide is configured to move said jaw plate in a direction which is neither parallel to nor perpendicular to said workpiece support surface;

an actuator configured to move said slide between said first position and said second position;

a tool-receiving aperture substantially aligned with said actuator; and a seal configured to inhibit debris from entering into said tool-receiving aperture but permit a tool to be inserted therethrough.

25. The device of claim 24, wherein said slide is configured to position said jaw plate against said workpiece support surface.

26. The device of claim 24, wherein said second jaw member further includes a detent member configured to engage said jaw plate and releasably hold said jaw plate in position.

27. The device of claim 24, further comprising a guide post extending from said jaw base, wherein said jaw plate comprises a slot defined therein, and wherein said slot is configured to receive said guide post when said jaw plate is assembled to said jaw base.

28. A device for holding a workpiece, said device comprising:

a base including a workpiece support surface;

a first jaw member; and a second jaw member, wherein one of said first jaw member and said second jaw member is movable relative to the other of said first jaw member and said second jaw member, wherein said first jaw member and said second jaw member are configured to hold a workpiece therebetween, said second jaw member including:

a jaw base;

a slide movable along a slide axis, wherein said slide is configured to move a jaw plate toward said jaw base;

an actuator configured to move said slide along said slide axis;

a tool-receiving aperture substantially aligned with said actuator; and a seal configured to inhibit debris from entering into said tool-receiving aperture but permit a tool to be inserted therethrough.

29. The device of claim 28, wherein said slide is configured to position the jaw plate against said workpiece support surface.

30. The device of claim 28, wherein said second jaw member further includes a detent member configured to engage the jaw plate and releasably hold the jaw plate in position.

31. The device of claim 28, further comprising said jaw plate and a guide post extending from said jaw base, wherein said jaw plate comprises a slot defined therein, and wherein said slot is configured to receive said guide post when said jaw plate is assembled to said jaw base.

32. A device for holding a workpiece, said device comprising:

a base including a workpiece support surface;

a first jaw member; and a second jaw member, wherein one of said first jaw member and said second jaw member is movable relative to the other of said first jaw member and said second jaw member, wherein said first jaw member and said second jaw member are configured to hold a workpiece therebetween, said second jaw member including:

a jaw base;

a slide movable along a slide axis, wherein said slide is configured to lock a jaw plate against said jaw base; and an actuator configured to move said slide along said slide axis, wherein said actuator is threadably engaged with said slide, wherein said actuator defines an actuator axis, and wherein said slide axis and said actuator axis are substantially parallel.

33. The device of claim 32, wherein said slide is configured to position the jaw plate against said workpiece support surface.

34. The device of claim 32, wherein said second jaw member further includes a detent member configured to engage the jaw plate and releasably hold the jaw plate in position.

35. The device of claim 32, further comprising said jaw plate and a guide post extending from said jaw base, wherein said jaw plate comprises a slot defined therein, and wherein said slot is configured to receive said guide post when said jaw plate is assembled to said jaw base.

36. A device for holding a workpiece, said device comprising:

a base including a workpiece support surface;

a first jaw member; and a second jaw member, wherein one of said first jaw member and said second jaw member is movable relative to the other of said first jaw member and said second jaw member, wherein said first jaw member and said second jaw member are configured to hold a workpiece therebetween, said second jaw member including:

a jaw base;

a slide movable along a slide axis, wherein said slide is configured to lock a jaw plate against said jaw base;

an actuator configured to move said slide along said slide axis;

a tool-receiving aperture substantially aligned with said actuator; and a seal configured to inhibit debris from entering into said tool-receiving aperture but permit a tool to be inserted therethrough.

37. The device of claim 36, wherein said slide is configured to position the jaw plate against said workpiece support surface.

38. The device of claim 36, wherein said second jaw member further includes a detent member configured to engage the jaw plate and releasably hold the jaw plate in position.

39. The device of claim 36, further comprising said jaw plate and a guide post extending from said jaw base, wherein said jaw plate comprises a slot defined therein, and wherein said slot is configured to receive said guide post when said jaw plate is assembled to said jaw base.

* * * * *